US011274678B2

(12) United States Patent
Teramoto et al.

(10) Patent No.: US 11,274,678 B2
(45) Date of Patent: Mar. 15, 2022

(54) CENTRIFUGAL BLOWER, AIR-SENDING DEVICE, AIR-CONDITIONING DEVICE, AND REFRIGERATION CYCLE DEVICE

(71) Applicant: Mitsubishi Electric Corporation, Tokyo (JP)

(72) Inventors: Takuya Teramoto, Tokyo (JP); Ryo Horie, Tokyo (JP); Takahiro Yamatani, Tokyo (JP); Kazuya Michikami, Tokyo (JP); Hiroshi Tsutsumi, Tokyo (JP); Hiroyasu Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/042,620

(22) PCT Filed: May 21, 2018

(86) PCT No.: PCT/JP2018/019480
§ 371 (c)(1),
(2) Date: Sep. 28, 2020

(87) PCT Pub. No.: WO2019/224869
PCT Pub. Date: Nov. 28, 2019

(65) Prior Publication Data

US 2021/0140445 A1 May 13, 2021

(51) Int. Cl.
*F04D 29/42* (2006.01)
*F04D 29/44* (2006.01)
(Continued)

(52) U.S. Cl.
CPC ..... *F04D 29/441* (2013.01); *F04D 29/4226* (2013.01); *F04D 29/66* (2013.01); *F05D 2210/12* (2013.01); *F24F 1/0022* (2013.01)

(58) Field of Classification Search
CPC ..... F04D 29/4226; F04D 29/441
See application file for complete search history.

(56) References Cited

U.S. PATENT DOCUMENTS 6,273,679 B1 * 8/2001 Na ..... F04D 29/441 415/204
7,488,151 B2 * 2/2009 Harman ..... F04D 29/4226 415/71
(Continued)

FOREIGN PATENT DOCUMENTS

EP 2 128 451 A1 12/2009
EP 2 757 268 A2 7/2014
(Continued)

OTHER PUBLICATIONS

Extended European Search Report dated Apr. 13, 2021, issued in corresponding European Patent Application No. 18919765.0.
(Continued)

*Primary Examiner* — Ninh H. Nguyen
(74) *Attorney, Agent, or Firm* — Posz Law Group, PLC

(57) ABSTRACT

A centrifugal blower includes a fan including a main plate having a disk-shape, and a plurality of blades, and a scroll casing configured to accommodate the fan. The scroll casing includes a discharge portion and a scroll portion including a side wall, a circumferential wall, and a tongue portion. The circumferential wall includes a curved circumferential wall and a flat circumferential wall. In comparison with a centrifugal blower including a standard circumferential wall having a logarithmic spiral shape in cross-section perpendicular to a rotational shaft of the fan, in the curved circumferential wall, at a first end being a boundary between the circumferential wall and the tongue portion and at a second end being a boundary between the circumferential wall and the discharge portion, a distance L1 between an axis of the rotational shaft and the circumferential wall is
(Continued)

equal to a distance L2 between the axis of the rotational shaft and the standard circumferential wall.

14 Claims, 12 Drawing Sheets

(51) Int. Cl.
*F04D 29/66* (2006.01)
*F24F 1/0022* (2019.01)

(56) References Cited

U.S. PATENT DOCUMENTS

| | | | | |
|---|---|---|---|---|
| 8,075,262 | B2 * | 12/2011 | Watanabe | F04D 29/4233 415/204 |
| 9,279,429 | B2 * | 3/2016 | Hancock | F04D 29/4226 |
| 2004/0253092 | A1 | 12/2004 | Hancock | |
| 2017/0058914 | A1 | 3/2017 | Cho et al. | |
| 2019/0242612 | A1 | 8/2019 | Teramoto et al. | |

FOREIGN PATENT DOCUMENTS

| | | | |
|---|---|---|---|
| EP | 2 757 269 | A2 | 7/2014 |
| JP | S58-070498 | U | 5/1983 |
| JP | 2005-240761 | A | 9/2005 |
| JP | 2008-240612 | A | 10/2008 |
| JP | 2008-267242 | A | 11/2008 |
| JP | 2010-216294 | A | 9/2010 |
| JP | 4906555 | B | 3/2012 |
| JP | 2014-125922 | A | 7/2014 |
| JP | 2016-033338 | A | 3/2016 |
| JP | 2016-061278 | A | 4/2016 |
| KR | 1020170024903 | A | 3/2017 |
| TW | 201818029 | A | 5/2018 |

OTHER PUBLICATIONS

International Search Report of the International Searching Authority dated Aug. 14, 2018 for the corresponding International application No. PCT/JP2018/019480 (and English translation).

Office Action dated Apr. 2, 2019 in the corresponding TW Patent application No. 107130132 (and English translation).

Office Action dated Jan. 21, 2022, issued in corresponding KR Patent Application No. 10-2020-7032727 (and English Machine Translation).

* cited by examiner

CENTRIFUGAL BLOWER, AIR-SENDING DEVICE, AIR-CONDITIONING DEVICE, AND REFRIGERATION CYCLE DEVICE

Cross Reference to Related Application

This application is a U.S. national stage application of International Application No. PCT/JP2018/019480 filed on May 21, 2018, the contents of which are incorporated herein by reference.

TECHNICAL FIELD

The present disclosure relates to a centrifugal blower including a scroll casing, and also relates to an air-sending device, an air-conditioning device, and a refrigeration cycle device each including the centrifugal blower.

BACKGROUND ART

Related-art centrifugal blowers may include a circumferential wall of a scroll casing that is formed into a logarithmic spiral shape in which a distance between an axis of a fan and the circumferential wall gradually increases from a downstream side of an air flow in the scroll casing to an upstream side of the air flow. If the extension rate of the distance between the axis of the fan and the circumferential wall of the scroll casing in the centrifugal blower is not sufficiently high in a direction of the air flow in the scroll casing, pressure recovery from a dynamic pressure to a static pressure is insufficient and the air-sending efficiency decreases. In addition, a loss is significant and the noise level increases. Therefore, a centrifugal blower including a spiral contour and two substantially parallel straight portions on the contour has been proposed (see, for example, Patent Literature 1). One of the straight portions is connected to a discharge port of a scroll and a rotational shaft of a motor is positioned closer to the straight portion near a tongue portion of the scroll. With this structure of the sirocco fan of Patent Literature 1, a backflow phenomenon can be suppressed, a predetermined amount of air can be maintained, and the noise level can be reduced.

CITATION LIST

Patent Literature

Patent Literature 1: Japanese Patent No. 4906555

SUMMARY OF INVENTION

Technical Problem

Although the noise level can be reduced in the centrifugal blower of Patent Literature 1, the pressure recovery from the dynamic pressure to the static pressure may be insufficient if the extension rate of the circumferential wall of the scroll casing cannot sufficiently be secured in a specific direction because the outer diameter dimension is limited by an installation place. Thus, the air-sending efficiency may decrease.

The present disclosure has been made to solve the problem described above and an object thereof is to provide a centrifugal blower, an air-sending device, an air-conditioning device, and a refrigeration cycle device in which the size can be reduced depending on an outer diameter dimension of an installation place, noise can be reduced, and air-sending efficiency can be improved.

Solution to Problem

A centrifugal blower according to an embodiment of the present disclosure includes a fan including a main plate having a disk-shape, and a plurality of blades installed on a circumferential portion of the main plate, and a scroll casing configured to accommodate the fan. The scroll casing includes a discharge portion forming a discharge port from which an air flow generated by the fan is discharged, and a scroll portion including a side wall covering the fan in an axis direction of a rotational shaft of the fan, and formed with a suction port configured to suction air, a circumferential wall encircling the fan in a radial direction of the rotational shaft, and a tongue portion provided between the discharge portion and the circumferential wall, and configured to guide the air flow generated by the fan to the discharge port. The circumferential wall includes a curved circumferential wall formed into a curved shape, and a flat circumferential wall formed into a flat shape. In comparison with a centrifugal blower including a standard circumferential wall having a logarithmic spiral shape in cross-section perpendicular to the rotational shaft of the fan, in the curved circumferential wall, at a first end being a boundary between the circumferential wall and the tongue portion and at a second end being a boundary between the circumferential wall and the discharge portion, a distance L1 between an axis of the rotational shaft and the circumferential wall is equal to a distance L2 between the axis of the rotational shaft and the standard circumferential wall. The distance L1 is greater than or equal to the distance L2 between the first end and the second end of the circumferential wall. The circumferential wall includes a plurality of extended portions between the first end and the second end of the circumferential wall. The plurality of extended portions include maximum points each having a length being a difference LH between the distance L1 and the distance L2. The flat circumferential wall is formed in at least one part on the curved circumferential wall.

Advantageous Effects of Invention

In the centrifugal blower according to the embodiment of the present disclosure, the circumferential wall includes the curved circumferential wall formed into the curved shape, and the flat circumferential wall formed into the flat shape. In comparison with the centrifugal blower including the standard circumferential wall having the logarithmic spiral shape in the cross-section perpendicular to the rotational shaft of the fan, in the curved circumferential wall, the distance L1 is equal to the distance L2 at the first end and at the second end. Further, in the curved circumferential wall, the distance L1 is greater than or equal to the distance L2 between the first end and the second end of the circumferential wall. Further, the circumferential wall includes the plurality of extended portions between the first end and the second end of the circumferential wall. The plurality of extended portions include the maximum points each having the length being the difference LH between the distance L1 and the distance L2. Further, the flat circumferential wall is formed in at least one part on the curved circumferential wall. Therefore, in the centrifugal blower including the flat circumferential wall, the vertical length of the scroll casing can be reduced even if the extension rate of the circumferential wall of the scroll casing cannot sufficiently be secured in a specific direction because the outer diameter dimension is limited by an installation place. Further, the centrifugal blower has the structure described above in a direction in which the circumferential wall can be extended, and therefore an air passage in which the distance between the axis of the rotational shaft and the circumferential wall is increased can be extended. As a result, the centrifugal blower can be downsized depending on the outer diameter dimension of the installation place, can prevent separation of an air flow, and convert a dynamic pressure into a static pressure by reducing the speed of the air flow passing through the scroll casing. Thus, noise can be reduced and the air-sending efficiency can be improved.

DESCRIPTION OF EMBODIMENTS

Figure 1:
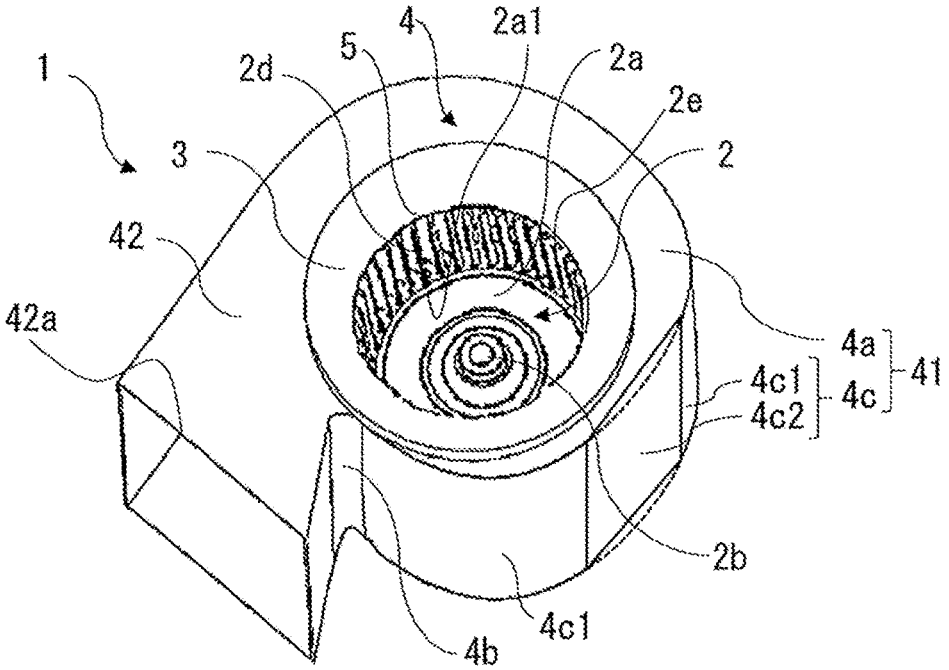
FIG. 1 is a perspective view of a centrifugal blower according to Embodiment 1 of the present disclosure.

A centrifugal blower 1, an air-sending device 30, an air-conditioning device 40, and a refrigeration cycle device 50 according to Embodiments 1 to 5 of the present disclosure are described below with reference to the drawings. Note that, in the drawings including FIG. 1 to which reference is made below, the relative relationship of dimensions of elements and the shapes thereof may differ from an actual relationship and actual shapes. Further, in the drawings to which reference is made below, elements represented by the same reference signs are identical or corresponding elements and are common throughout the description herein. Further, terms of directions (for example, "up", "down", "right", "left", "front", and "rear") are used as appropriate for facilitating understanding. Those terms are used only for convenience of the description but do not limit dispositions and directions of devices or components.

Embodiment 1

[Centrifugal Blower 1]

Figure 2:
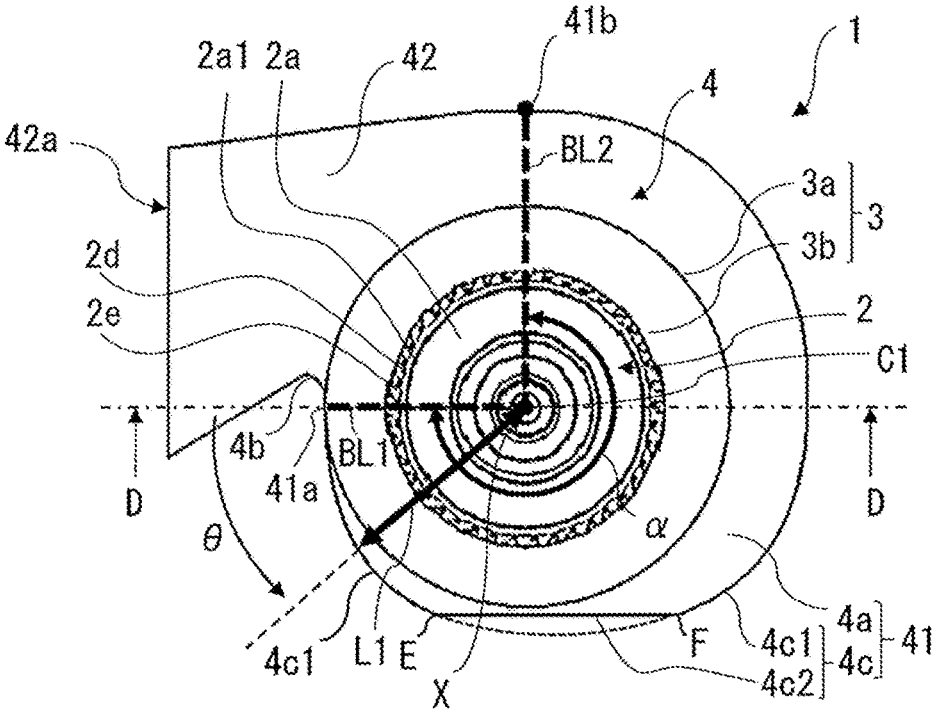
FIG. 2 is a top view of the centrifugal blower according to Embodiment 1 of the present disclosure.
Figure 3:
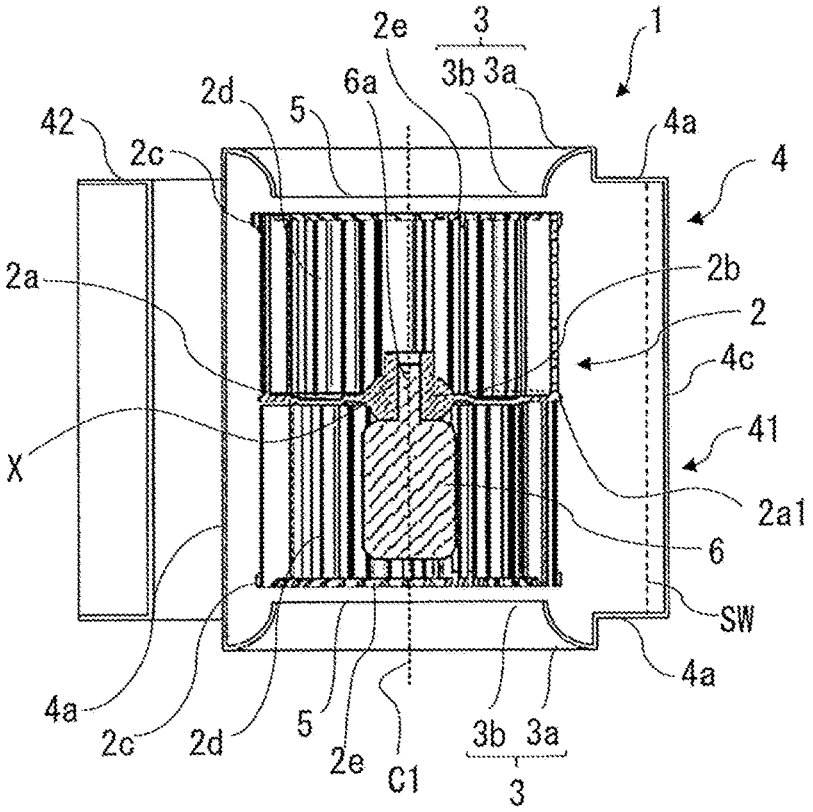
FIG. 3 is a sectional view of the centrifugal blower cut along the line D-D in FIG. 2.
Figure 4:
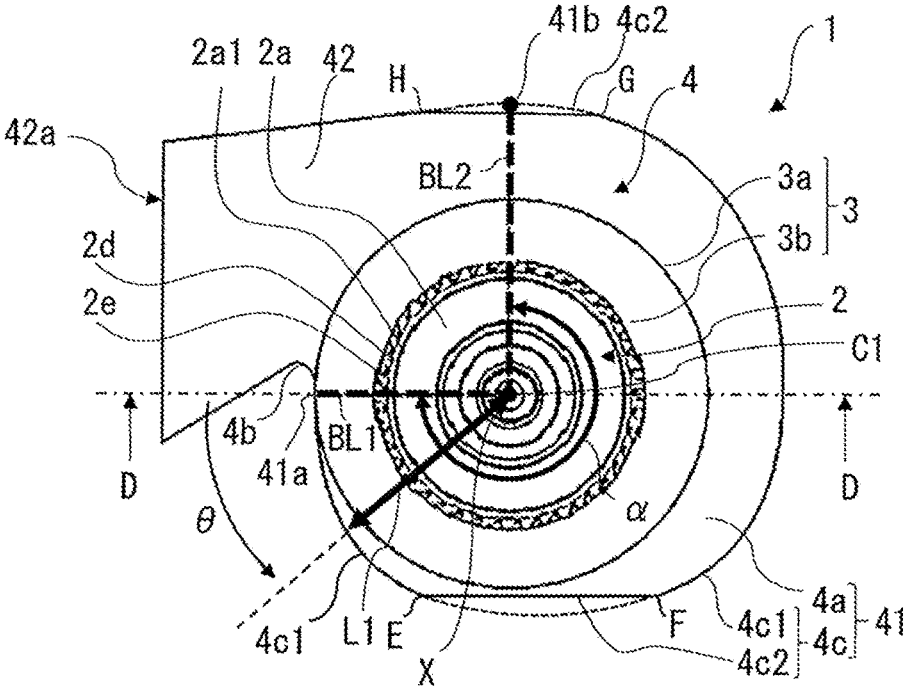
FIG. 4 is a top view of another centrifugal blower according to Embodiment 1 of the present disclosure.

FIG. 1 is a perspective view of the centrifugal blower 1 according to Embodiment 1 of the present disclosure. FIG. 2 is a top view of the centrifugal blower 1 according to Embodiment 1 of the present disclosure. FIG. 3 is a sectional view of the centrifugal blower 1 cut along the line D-D in FIG. 2. FIG. 4 is a top view of another centrifugal blower according to Embodiment 1 of the present disclosure. The basic structure of the centrifugal blower 1 is described with reference to FIG. 1 to FIG. 4. Note that the broken lines in FIG. 2 and FIG. 4 are imaginary lines of a curved circumferential wall 4*c*1. Further, the dotted line in FIG. 3 shows a cross-section of a standard circumferential wall SW, which is a circumferential wall of a related-art centrifugal blower. The centrifugal blower 1 is a multi-blade centrifugal blower including a fan 2 configured to generate an air flow, and a scroll casing 4 configured to accommodate the fan 2.

(Fan 2)

The fan 2 includes a main plate 2*a* having a disk-shape, and a plurality of blades 2*d* installed on a circumferential portion 2*a*1 of the main plate 2*a*. As illustrated in FIG. 3, the fan 2 further includes a ring-shaped side plate 2*c* facing the main plate 2*a* at the ends of the plurality of blades 2*d* opposite to the ends close to the main plate 2*a*. Note that the fan 2 may have a structure without the side plate 2*c*. If the fan 2 includes the side plate 2*c*, one end of each of the plurality of blades 2*d* is connected to the main plate 2*a* and the other end of each of the plurality of blades 2*d* is connected to the side plate 2*c*. Thus, the plurality of blades 2*d* are disposed between the main plate 2*a* and the side plate 2*c*. A boss 2*b* is provided at the center of the main plate 2*a*. An output shaft 6*a* of a fan motor 6 is connected to the center of the boss 2*b*. The fan 2 is rotated by a drive force of the fan motor 6. The fan 2 has a rotational shaft X formed by the boss 2*b* and the output shaft 6*a*. The plurality of blades 2*d* encircle the rotational shaft X of the fan 2 between the main plate 2*a* and the side plate 2*c*. The fan 2 is formed into a cylindrical shape by the main plate 2*a* and the plurality of blades 2*d* and has a suction port 2*e* close to the side plate 2*c* opposite to the main plate 2*a* in an axis direction of the rotational shaft X of the fan 2. As illustrated in FIG. 3, the fan 2 is provided with pluralities of blades 2*d* on both sides of the main plate 2*a* in the axis direction of the rotational shaft X. Note that the structure of the fan 2 is not limited to the structure in which the pluralities of blades 2*d* are provided on both sides of the main plate 2*a* in the axis direction of the rotational shaft X. For example, the plurality of blades 2*d* may be provided on one side of the main plate 2*a* in the axis direction of the rotational shaft X. Further, the fan motor 6 is disposed on the inner circumference of the fan 2 as illustrated in FIG. 3 but it is appropriate that the output shaft 6*a* be connected to the boss 2*b* of the fan 2. The fan motor 6 may be disposed outside the centrifugal blower 1.

(Scroll Casing 4)

The scroll casing 4 encircles the fan 2 and regulates a flow of air blown from the fan 2. The scroll casing 4 includes a discharge portion 42 forming a discharge port 42*a* from which an air flow generated by the fan 2 is discharged, and a scroll portion 41 forming an air passage through which a dynamic pressure of the air flow generated by the fan 2 is converted into a static pressure. The discharge portion 42 forms the discharge port 42*a* from which the air flow passing through the scroll portion 41 is discharged. The scroll portion 41 includes side walls 4*a* covering the fan 2 in the axis direction of the rotational shaft X of the fan 2 and formed with suction ports 5 configured to suction air, and a circumferential wall 4*c* encircling the fan 2 in a radial direction of the rotational shaft X. The scroll portion 41 further includes a tongue portion 4*b* provided between the discharge portion 42 and the circumferential wall 4*c* and configured to guide the air flow generated by the fan 2 to the discharge port 42*a* via the scroll portion 41. Note that the radial direction of the rotational shaft X is a direction perpendicular to the rotational shaft X. The air blown from the fan 2 flows along the circumferential wall 4*c* in the internal space of the scroll portion 41, which is defined by the circumferential wall 4*c* and the side walls 4*a*.

(Side Wall 4*a*)

Each side wall 4*a* of the scroll casing 4 has the suction port 5. Further, the side wall 4*a* is provided with a bellmouth 3 configured to guide an air flow to be suctioned into the scroll casing 4 through the suction port 5. The bellmouth 3 is formed in a part where the bellmouth 3 faces the suction port 2*e* of the fan 2. The bellmouth 3 has a shape in which an air passage is narrowed from an upstream end 3*a*, which is an end on an upstream side of the air flow to be suctioned into the scroll casing 4 through the suction port 5, toward a downstream end 3*b*, which is an end on a downstream side of the air flow. As illustrated in FIG. 1 to FIG. 4, the centrifugal blower 1 includes a double-suction scroll casing 4 including the side walls 4*a* having the suction ports 5 on both sides of the main plate 2*a* in the axis direction of the rotational shaft X. Note that the centrifugal blower 1 is not limited to the centrifugal blower including the double-suction scroll casing 4. The centrifugal blower 1 may include a single-suction scroll casing 4 including the side wall 4*a* having the suction port 5 on one side of the main plate 2*a* in the axis direction of the rotational shaft X.

(Circumferential Wall 4*c*)

The circumferential wall 4*c* encircles the fan 2 in the radial direction of the rotational shaft X and has an inner circumferential surface facing the plurality of blades 2*d* on the outer circumference of the fan 2 in the radial direction. As illustrated in FIG. 2, the circumferential wall 4*c* is provided in a part ranging from a first end 41*a* being a boundary between the tongue portion 4*b* and the scroll portion 41 to a second end 41*b* being a boundary between the discharge portion 42 and the scroll portion 41 located away from the tongue portion 4*b* along a rotational direction of the fan 2. In the circumferential wall 4*c* having a curved surface, the first end 41*a* is an end on an upstream side of an air flow generated by rotation of the fan 2, and the second end 41*b* is an end on a downstream side of the air flow generated by the rotation of the fan 2.

The circumferential wall 4*c* includes the curved circumferential wall 4*c*1 formed into a curved shape, and a flat circumferential wall 4*c*2 formed into a flat shape. The curved circumferential wall 4*c*1 is wide in the axis direction of the rotational shaft X and is formed into a spiral shape in top view. The inner circumferential surface of the curved circumferential wall 4*c*1 is a curved surface that is smoothly curved along a circumferential direction of the fan 2 from the first end 41*a* at the start of the spiral to the second end 41*b* at the finish of the spiral. The circumferential wall 4*c* includes the flat circumferential wall 4*c*2 in one part on the curved circumferential wall 4*c*1 between the first end 41*a* and the second end 41*b*. The flat circumferential wall 4*c*2 is obtained by forming one part on the circumferential wall 4*c* into a flat shape. As illustrated in FIG. 2, the flat circumferential wall 4*c*2 has a straight portion EF on a spiral contour of the curved circumferential wall 4*c*1 in top view. Here, an angle θ is defined along the rotational direction of the fan 2 from a first reference line BL1 connecting an axis C1 of the rotational shaft X and the first end 41*a* toward a second reference line BL2 connecting the axis C1 of the rotational shaft X and the second end 41*b* in cross-section perpendicular to the rotational shaft X of the fan 2. Then, the flat circumferential wall 4*c*2 is formed in a part where the angle θ is 90 degrees. Further, as illustrated in FIG. 4, a plurality of flat circumferential walls 4*c*2 are formed on the circumferential wall 4*c* and the straight portion EF and a straight portion GH are formed on the spiral contour of the curved circumferential wall 4*c*1 in top view. Further, the flat circumferential wall 4*c*2 having the straight portion GH is formed in a part where the angle θ is 270 degrees. As illustrated in FIG. 4, the straight portion GH is formed over the scroll portion 41 and the discharge portion 42. That is, the flat circumferential wall 4*c*2 may be formed on the discharge portion 42 as exemplified by the flat circumferential wall 4c2 having the straight portion GH. The number of the flat circumferential walls 4c2 on the circumferential wall 4c is not limited to one or two. It is appropriate that at least one flat circumferential wall 4c2 be formed on the circumferential wall 4c. Note that, as illustrated in FIG. 2 and FIG. 4, parts of the curved circumferential wall 4c1 where the flat circumferential walls 4c2 are provided on the circumferential wall 4c are shown by the broken lines as imaginary circumferential walls 4c.

As described above, the angle θ illustrated in FIG. 2 is defined along the rotational direction of the fan 2 from the first reference line BL1 connecting the axis C1 of the rotational shaft X and the first end 41a toward the second reference line BL2 connecting the axis C1 of the rotational shaft X and the second end 41b in the cross-section perpendicular to the rotational shaft X of the fan 2. In FIG. 2, the angle θ at the first reference line BL1 is 0 degrees. Note that the angle at the second reference line BL2 is an angle α, which is not a specific value. This is because the angle α at the second reference line BL2 varies depending on the spiral shape of the scroll casing 4, which is determined by, for example, an opening diameter of the discharge port 42a. The angle α at the second reference line BL2 is specifically determined by, for example, an opening diameter of the discharge port 42a that is required for use of the centrifugal blower 1. Therefore, the angle α is described to be 270 degrees in the centrifugal blower 1 of Embodiment 1 but may be, for example, 300 degrees depending on the opening diameter of the discharge port 42a. Similarly, the position of the standard circumferential wall SW having a logarithmic spiral shape is determined by an opening diameter of the discharge port 42a of the discharge portion 42 in a direction perpendicular to the rotational shaft X.

Figure 5:
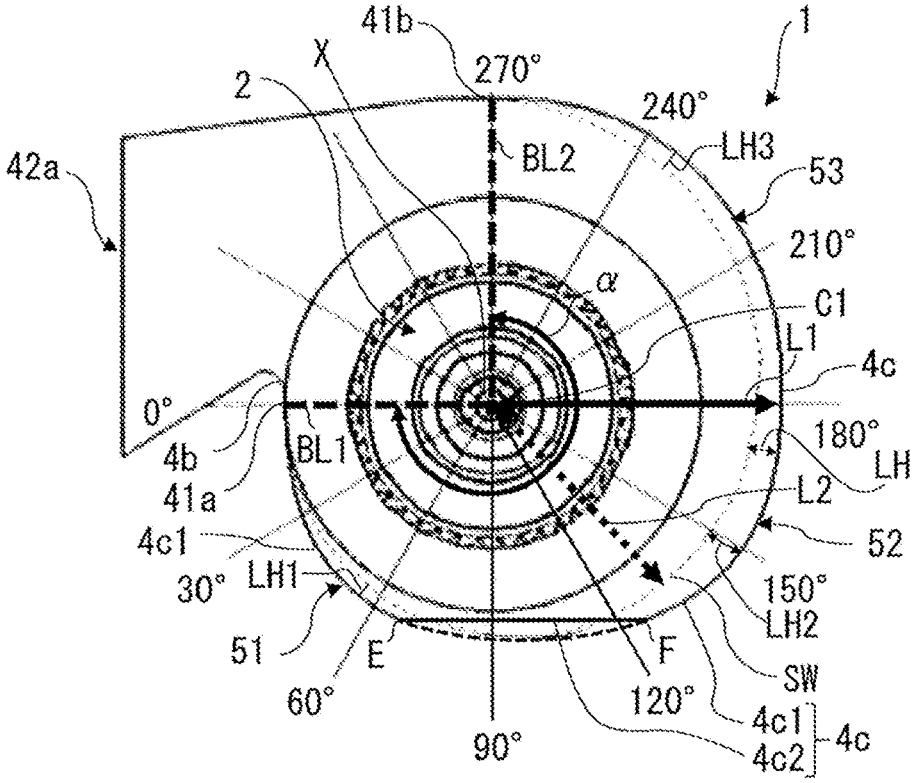
FIG. 5 is a top view illustrating comparison between a circumferential wall of the centrifugal blower according to Embodiment 1 of the present disclosure and a standard circumferential wall having a logarithmic spiral shape in a related-art centrifugal blower.
Figure 6:
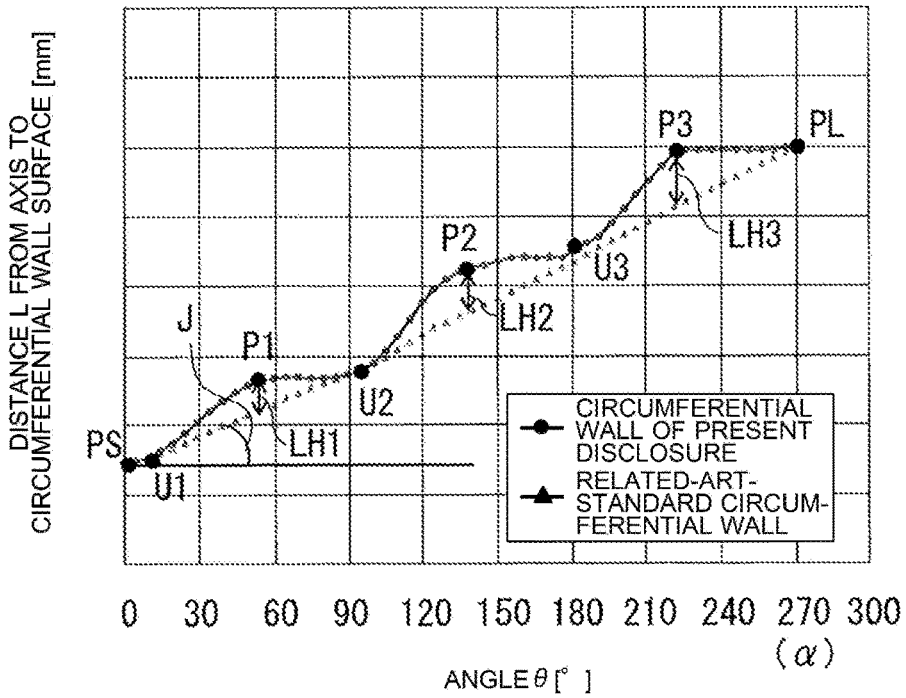
FIG. 6 is a diagram illustrating a relationship between an angle θ [degree] and a distance L [mm] from an axis to a circumferential wall surface in the centrifugal blower 1 or the related-art centrifugal blower of FIG. 5.

FIG. 5 is a top view illustrating comparison between the circumferential wall 4c of the centrifugal blower 1 according to Embodiment 1 of the present disclosure and the standard circumferential wall SW having the logarithmic spiral shape in the related-art centrifugal blower. FIG. 6 is a diagram illustrating a relationship between the angle θ [degree] and a distance L [mm] from the axis to the circumferential wall surface in the centrifugal blower 1 or the related-art centrifugal blower of FIG. 5. In FIG. 6, the solid line connecting circles shows the curved circumferential wall 4c1 and the broken line connecting triangles shows the standard circumferential wall SW. The curved circumferential wall 4c1 is described in more detail by comparing the centrifugal blower 1 with the centrifugal blower including the standard circumferential wall SW having the logarithmic spiral shape in the cross-section perpendicular to the rotational shaft X of the fan 2. The standard circumferential wall SW of the related-art centrifugal blower in FIG. 5 and FIG. 6 has a curved surface having a spiral shape defined by a predetermined extension rate (constant extension rate). Examples of the standard circumferential wall SW having the spiral shape defined by the predetermined extension rate include a standard circumferential wall SW having a logarithmic spiral, a standard circumferential wall SW having an Archimedean spiral, and a standard circumferential wall SW having an involute curve. Although the standard circumferential wall SW in the specific example of the related-art centrifugal blower in FIG. 5 is defined by the logarithmic spiral, the standard circumferential wall SW of the related-art centrifugal blower may be the standard circumferential wall SW having the Archimedean spiral or the standard circumferential wall SW having the involute curve. As illustrated in FIG. 6, an extension rate J that defines the standard circumferential wall SW as the circumferential wall having the logarithmic spiral shape in the related-art centrifugal blower is an angle of a slope in a graph in which the horizontal axis represents the angle θ corresponding to a turning angle and the vertical axis represents the distance between the axis C1 of the rotational shaft X and the standard circumferential wall SW.

In FIG. 6, a point PS shows a position of the first end 41a of the circumferential wall 4c and a radius of the standard circumferential wall SW of the related-art centrifugal blower. Further, a point PL in FIG. 6 shows a position of the second end 41b of the circumferential wall 4c and a radius of the standard circumferential wall SW of the related-art centrifugal blower. As illustrated in FIG. 5 and FIG. 6, in the curved circumferential wall 4c1, a distance L1 between the axis C1 of the rotational shaft X and the circumferential wall 4c is equal to a distance L2 between the axis C1 of the rotational shaft X and the standard circumferential wall SW at the first end 41a being a boundary between the circumferential wall 4c and the tongue portion 4b. Further, in the curved circumferential wall 4c1, the distance L1 between the axis C1 of the rotational shaft X and the circumferential wall 4c is equal to the distance L2 between the axis C1 of the rotational shaft X and the standard circumferential wall SW at the second end 41b being a boundary between the circumferential wall 4c and the discharge portion 42.

As illustrated in FIG. 5 and FIG. 6, in the curved circumferential wall 4c1, the distance L1 between the axis C1 of the rotational shaft X and the curved circumferential wall 4c1 is greater than or equal to the distance L2 between the axis C1 of the rotational shaft X and the standard circumferential wall SW in a part between the first end 41a and the second end 41b of the circumferential wall 4c. Further, the curved circumferential wall 4c1 includes three extended portions between the first end 41a and the second end 41b of the circumferential wall 4c, and the three extended portions include maximum points each having a length being a difference LH between the distance L1 between the axis C1 of the rotational shaft X and the curved circumferential wall 4c1 and the distance L2 between the axis C1 of the rotational shaft X and the standard circumferential wall SW.

As illustrated in FIG. 5, the curved circumferential wall 4c1 includes a first extended portion 51 bulging radially outward from the standard circumferential wall SW having the logarithmic spiral shape in a range of the angle θ greater than or equal to 0 degrees and smaller than 90 degrees. As illustrated in FIG. 6, the first extended portion 51 includes a first maximum point P1 in the range of the angle θ greater than or equal to 0 degrees and smaller than 90 degrees. As illustrated in FIG. 6, the first maximum point P1 is a position on the curved circumferential wall 4c1 in the range of the angle θ greater than or equal to 0 degrees and smaller than 90 degrees, and has a maximum length being a difference LH1 between the distance L1 between the axis C1 of the rotational shaft X and the curved circumferential wall 4c1 and the distance L2 between the axis C1 of the rotational shaft X and the standard circumferential wall SW. As illustrated in FIG. 5, the curved circumferential wall 4c1 includes a second extended portion 52 bulging radially outward from the standard circumferential wall SW having the logarithmic spiral shape in a range of the angle θ greater than or equal to 90 degrees and smaller than 180 degrees. As illustrated in FIG. 6, the second extended portion 52 includes a second maximum point P2 in the range of the angle θ greater than or equal to 90 degrees and smaller than 180 degrees. As illustrated in FIG. 6, the second maximum point P2 is a position on the curved circumferential wall 4c1 in the range of the angle θ greater than or equal to 90 degrees and smaller than 180 degrees, and has a maximum length being a difference LH2 between the distance L1 between the axis C1 of the rotational shaft X and the curved circumferential wall 4c1 and the distance L2 between the axis C1 of the rotational shaft X and the standard circumferential wall SW. As illustrated in FIG. 5, the curved circumferential wall 4c1 includes a third extended portion 53 bulging radially outward from the standard circumferential wall SW having the logarithmic spiral shape in a range of the angle θ greater than or equal to 180 degrees and smaller than the angle α at the second reference line. As illustrated in FIG. 6, the third extended portion 53 includes a third maximum point P3 in the range of the angle θ greater than or equal to 180 degrees and smaller than the angle α at the second reference line. As illustrated in FIG. 6, the third maximum point P3 is a position on the curved circumferential wall 4c1 in the range of the angle θ greater than or equal to 180 degrees and smaller than the angle α, and has a maximum length being a difference LH3 between the distance L1 between the axis C1 of the rotational shaft X and the curved circumferential wall 4c1 and the distance L2 between the axis C1 of the rotational shaft X and the standard circumferential wall SW.

Figure 7:
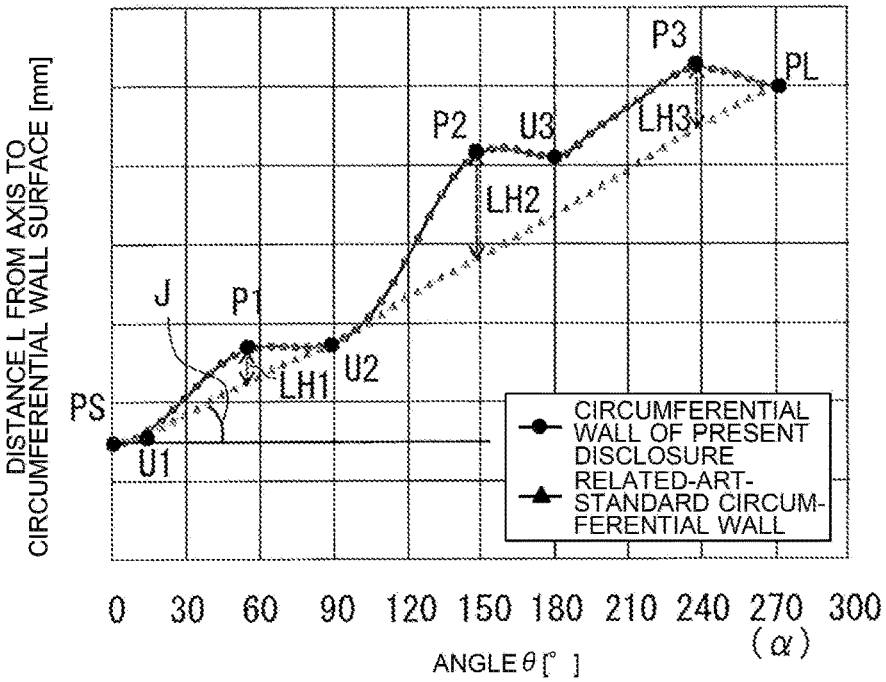
FIG. 7 is a diagram illustrating how extension rates of extended portions are changed in the circumferential wall of the centrifugal blower according to Embodiment 1 of the present disclosure.
Figure 8:
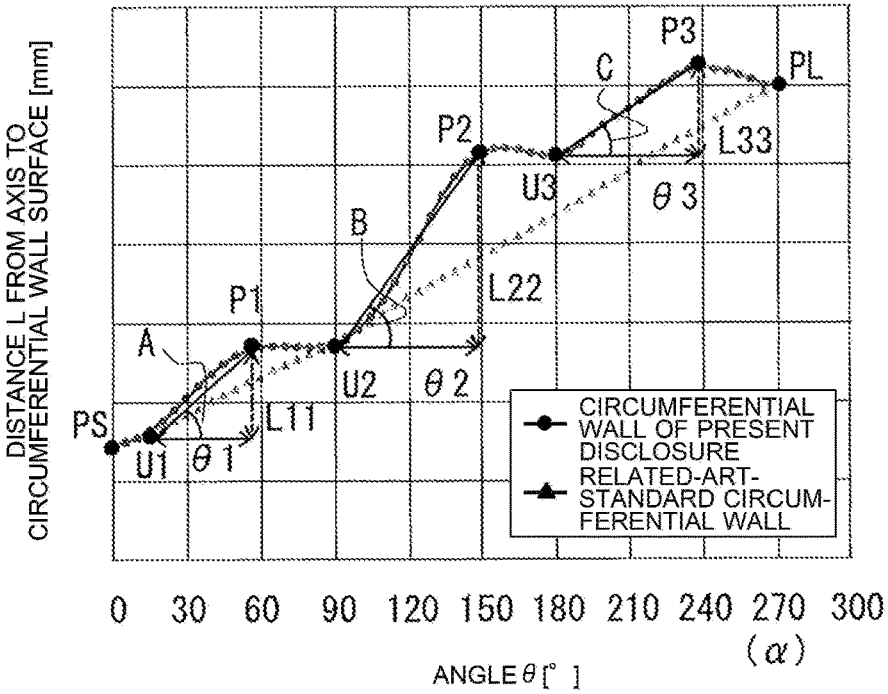
FIG. 8 is a diagram illustrating a difference among the extension rates of the extended portions of the circumferential wall of the centrifugal blower according to Embodiment 1 of the present disclosure.

FIG. 7 is a diagram illustrating how extension rates of the extended portions are changed in the circumferential wall 4c of the centrifugal blower 1 according to Embodiment 1 of the present disclosure. FIG. 8 is a diagram illustrating a difference among the extension rates of the extended portions of the circumferential wall 4c of the centrifugal blower 1 according to Embodiment 1 of the present disclosure. As illustrated in FIG. 7, a first minimum point U1 is given as a point where the difference LH is minimum in a range of the angle θ greater than or equal to 0 degrees and smaller than an angle at the first maximum point P1. Further, a second minimum point U2 is given as a point where the difference LH is minimum in a range of the angle θ greater than or equal to 90 degrees and smaller than an angle at the second maximum point P2. Further, a third minimum point U3 is given as a point where the difference LH is minimum in a range of the angle θ greater than or equal to 180 degrees and smaller than an angle at the third maximum point P3. In those cases, as illustrated in FIG. 8, an extension rate A is a difference L11 between the distance L1 at the first maximum point P1 and the distance L1 at the first minimum point U1 relative to an increase θ1 in the angle θ from the first minimum point U1 to the first maximum point P1. Further, an extension rate B is a difference L22 between the distance L1 at the second maximum point P2 and the distance L1 at the second minimum point U2 relative to an increase θ2 in the angle θ from the second minimum point U2 to the second maximum point P2. Further, an extension rate C is a difference L33 between the distance L1 at the third maximum point P3 and the distance L1 at the third minimum point U3 relative to an increase θ3 in the angle θ from the third minimum point U3 to the third maximum point P3. At this time, the curved circumferential wall 4c1 of the centrifugal blower 1 has a relationship of extension rate B>extension rate C and extension rate B≥extension rate A>extension rate C or a relationship of extension rate B>extension rate C and extension rate B>extension rate C≥extension rate A.

Figure 9:
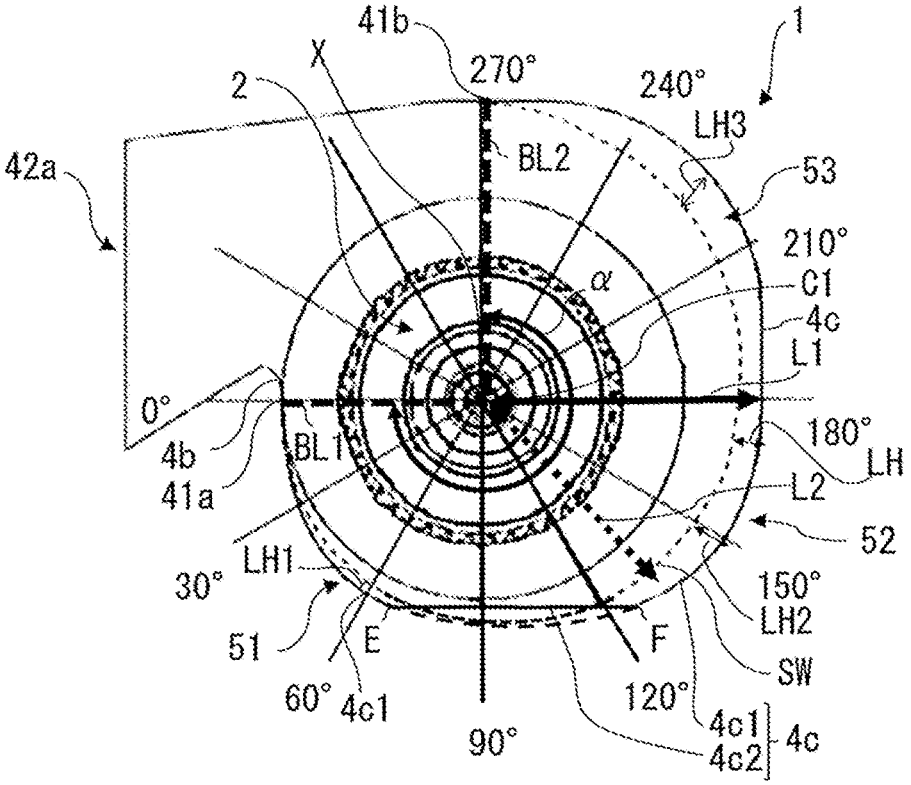
FIG. 9 is a top view illustrating comparison between a circumferential wall having other extension rates in the centrifugal blower according to Embodiment 1 of the present disclosure and the standard circumferential wall SW having the logarithmic spiral shape in the related-art centrifugal blower.
Figure 10:
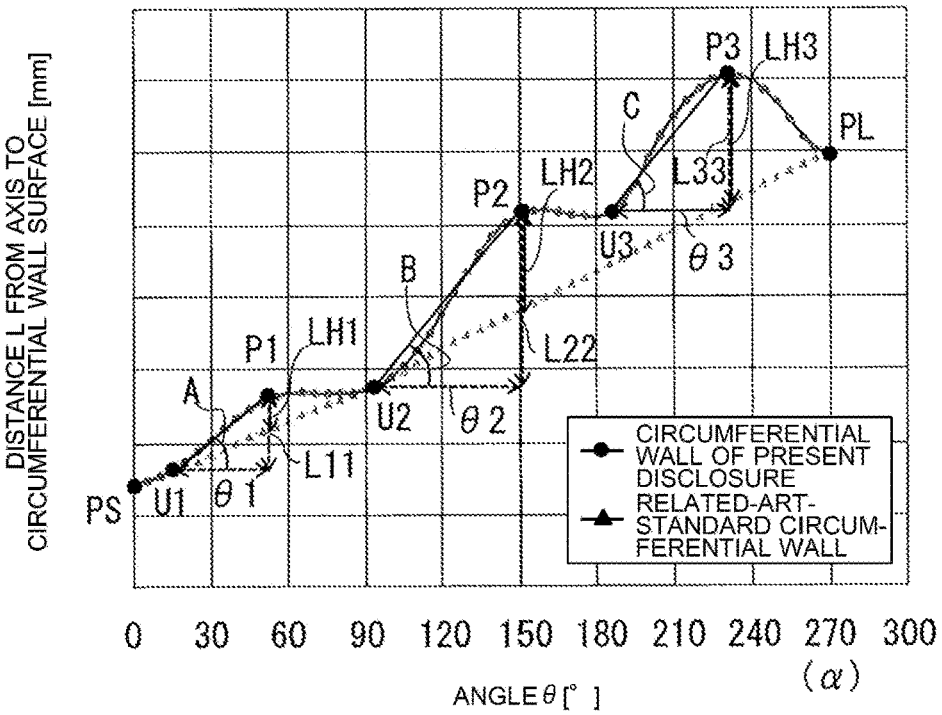
FIG. 10 is a diagram illustrating how the other extension rates of the extended portions are changed in the circumferential wall of the centrifugal blower of FIG. 9.

FIG. 9 is a top view illustrating comparison between a circumferential wall 4c having other extension rates in the centrifugal blower 1 according to Embodiment 1 of the present disclosure and the standard circumferential wall SW having the logarithmic spiral shape in the related-art centrifugal blower. FIG. 10 is a diagram illustrating how the other extension rates of the extended portions are changed in the circumferential wall 4c of the centrifugal blower 1 of FIG. 9. As illustrated in FIG. 10, a first minimum point U1 is given as a point where the difference LH is minimum in a range of the angle θ greater than or equal to 0 degrees and smaller than an angle at a first maximum point P1. Further, a second minimum point U2 is given as a point where the difference LH is minimum in a range of the angle θ greater than or equal to 90 degrees and smaller than an angle at a second maximum point P2. Further, a third minimum point U3 is given as a point where the difference LH is minimum in a range of the angle θ greater than or equal to 180 degrees and smaller than an angle at a third maximum point P3. In those cases, as illustrated in FIG. 10, an extension rate A is a difference L11 between the distance L1 at the first maximum point P1 and the distance L1 at the first minimum point U1 relative to an increase θ1 in the angle θ from the first minimum point U1 to the first maximum point P1. Further, an extension rate B is a difference L22 between the distance L1 at the second maximum point P2 and the distance L1 at the second minimum point U2 relative to an increase θ2 in the angle θ from the second minimum point U2 to the second maximum point P2. Further, an extension rate C is a difference L33 between the distance L1 at the third maximum point P3 and the distance L1 at the third minimum point U3 relative to an increase θ3 in the angle θ from the third minimum point U3 to the third maximum point P3. At this time, the curved circumferential wall 4c1 of the centrifugal blower 1 has a relationship of extension rate C>extension rate B≥extension rate A.

Figure 11:
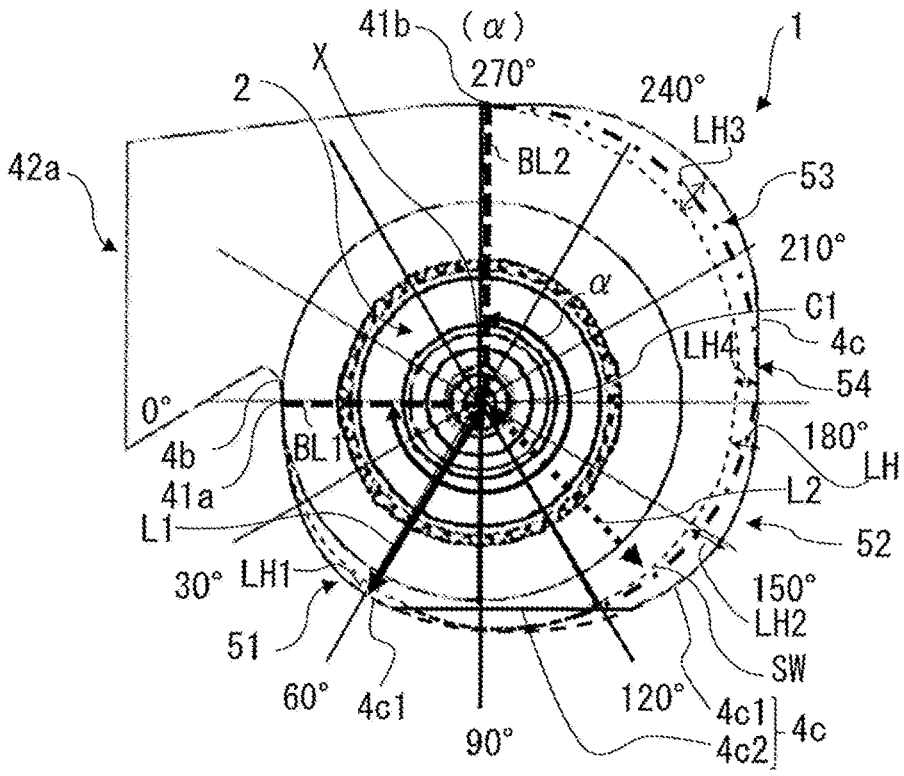
FIG. 11 is a top view illustrating comparison between a circumferential wall having other extension rates in the centrifugal blower according to Embodiment 1 of the present disclosure and the standard circumferential wall SW having the logarithmic spiral shape in the related-art centrifugal blower.
Figure 12:
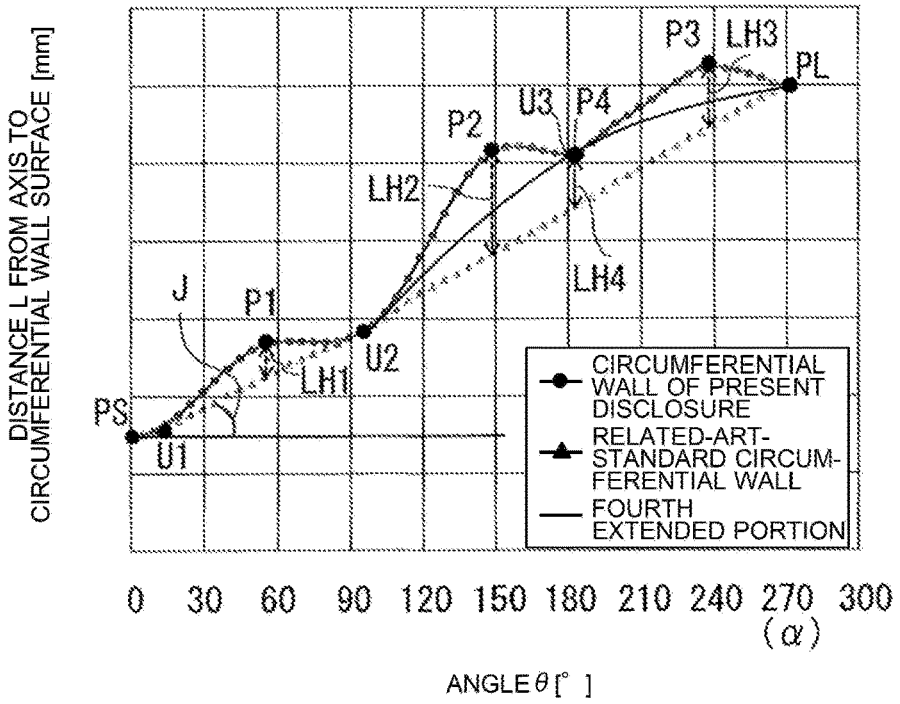
FIG. 12 is a diagram illustrating how the other extension rates of the extended portions are changed in the circumferential wall of the centrifugal blower of FIG. 11.

FIG. 11 is a top view illustrating comparison between a circumferential wall 4c having other extension rates in the centrifugal blower 1 according to Embodiment 1 of the present disclosure and the standard circumferential wall SW having the logarithmic spiral shape in the related-art centrifugal blower. FIG. 12 is a diagram illustrating how the other extension rates of the extended portions are changed in the circumferential wall 4c of the centrifugal blower 1 of FIG. 11. Note that the chain line illustrated in FIG. 11 shows a position of a fourth extended portion 54. In the centrifugal blower 1 according to Embodiment 1 in FIG. 11, the curved circumferential wall 4c1 includes the fourth extended portion 54 including a fourth maximum point P4 in a range of the angle θ from 90 degrees to 270 degrees (angle α) in a region opposite to the discharge port 72 of the scroll casing 4. In the centrifugal blower 1 according to Embodiment 1 in FIG. 11, the curved circumferential wall 4c1 further includes a second extended portion 52 including a second maximum point P2 and a third extended portion 53 including a third maximum point P3 on the fourth extended portion 54 including the fourth maximum point P4. As illustrated in FIG. 11, the curved circumferential wall 4c1 includes a first extended portion 51 bulging radially outward from the standard circumferential wall SW having the logarithmic spiral shape in the range of the angle θ greater than or equal to 0 degrees and smaller than 90 degrees. As illustrated in FIG. 12, the first extended portion 51 includes a first maximum point P1 in the range of the angle θ greater than or equal to 0 degrees and smaller than 90 degrees. The first maximum point P1 is a position on the curved circumferential wall 4c1 in the range of the angle θ greater than or equal to 0 degrees and smaller than 90 degrees, and has a maximum length being a difference LH1 between the distance L1 between the axis C1 of the rotational shaft X and the curved circumferential wall 4c1 and the distance L2 between the axis C1 of the rotational shaft X and the standard circumferential wall SW. As illustrated in FIG. 11, the curved circumferential wall 4c1 further includes the second extended portion 52 bulging radially outward from the standard circumferential wall SW having the logarithmic spiral shape in the range of the angle θ greater than or equal to 90 degrees and smaller than 180 degrees. As illustrated in FIG. 12, the second extended portion 52 includes the second maximum point P2 in the range of the angle θ greater than or equal to 90 degrees and smaller than 180 degrees. The second maximum point P2 is a position on the curved circumferential wall 4c1 in the range of the angle θ greater than or equal to 90 degrees and smaller than 180 degrees, and has a maximum length being a difference LH2 between the distance L1 between the axis C1 of the rotational shaft X and the curved circumferential wall 4c1 and the distance L2 between the axis C1 of the rotational shaft X and the standard circumferential wall SW. As illustrated in FIG. 11, the curved circumferential wall 4c1 further includes the third extended portion 53 bulging radially outward from the standard circumferential wall SW having the logarithmic spiral shape in the range of the angle θ greater than or equal to 180 degrees and smaller than the angle α at the second reference line. As illustrated in FIG. 12, the third extended portion 53 includes the third maximum point P3 in the range of the angle θ greater than or equal to 180 degrees and smaller than the angle α at the second reference line. The third maximum point P3 is a position on the curved circumferential wall 4c1 in the range of the angle θ greater than or equal to 180 degrees and smaller than the angle α, and has a maximum length being a difference LH3 between the distance L1 between the axis C1 of the rotational shaft X and the curved circumferential wall 4c1 and the distance L2 between the axis C1 of the rotational shaft X and the standard circumferential wall SW. As illustrated in FIG. 11, the curved circumferential wall 4c1 includes the fourth extended portion 54 bulging radially outward from the standard circumferential wall SW having the logarithmic spiral shape in the range of the angle θ greater than or equal to 90 degrees and smaller than the angle α at the second reference line. As illustrated in FIG. 12, the fourth extended portion 54 includes the fourth maximum point P4 in the range of the angle θ greater than or equal to 90 degrees and smaller than the angle α at the second reference line. The fourth maximum point P4 is a position on the curved circumferential wall 4c1 in the range of the angle θ greater than or equal to 90 degrees and smaller than the angle α, and has a maximum length being a difference LH4 between the distance L1 between the axis C1 of the rotational shaft X and the curved circumferential wall 4c1 and the distance L2 between the axis C1 of the rotational shaft X and the standard circumferential wall SW. In the centrifugal blower 1, the curved circumferential wall 4c1 further includes the second extended portion 52 including the second maximum point P2 and the third extended portion 53 including the third maximum point P3 on the fourth extended portion 54 including the fourth maximum point P4. Therefore, in the curved circumferential wall 4c1 corresponding to the region from the second extended portion 52 to the third extended portion 53, the distance L1 between the axis C1 of the rotational shaft X and the curved circumferential wall 4c1 is greater than the distance L2 between the axis C1 of the rotational shaft X and the standard circumferential wall SW.

Figure 13:
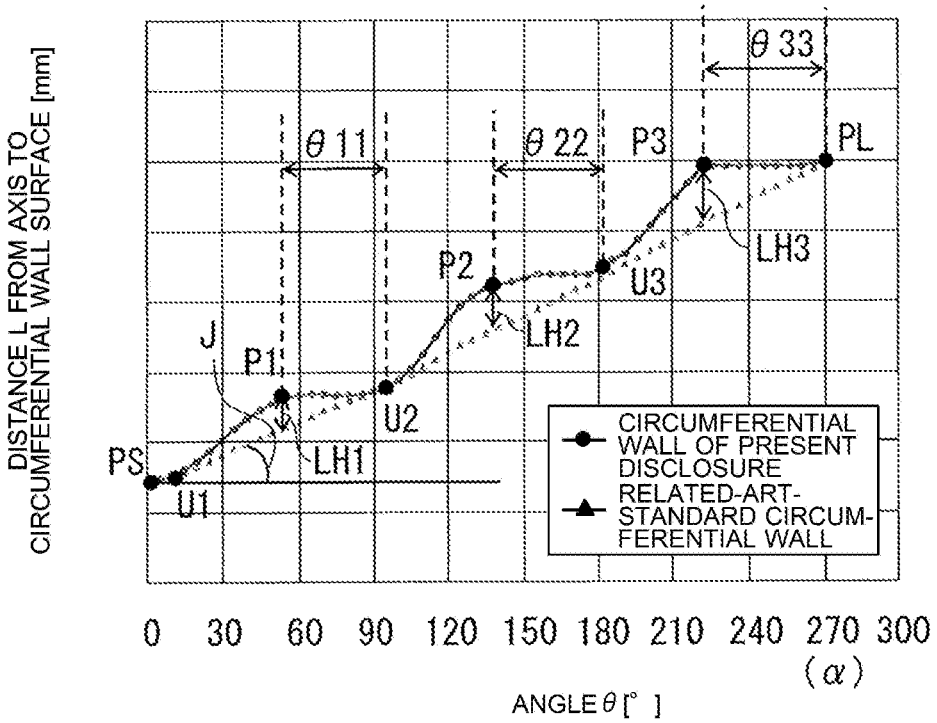
FIG. 13 is a diagram illustrating other extension rates in the circumferential wall of the centrifugal blower according to Embodiment 1 in FIG. 6.

FIG. 13 is a diagram illustrating other extension rates in the circumferential wall 4c of the centrifugal blower 1 according to Embodiment 1 in FIG. 6. FIG. 13 illustrates a further desirable shape of the curved circumferential wall 4c1 with reference to FIG. 6. An extension rate D is a difference L44 (not illustrated) between the distance L1 at the second minimum point U2 and the distance L1 at the first maximum point P1 relative to an increase θ11 in the angle θ from the first maximum point P1 to the second minimum point U2. Further, an extension rate E is a difference L55 (not illustrated) between the distance L1 at the third minimum point U3 and the distance L1 at the second maximum point P2 relative to an increase θ22 in the angle θ from the second maximum point P2 to the third minimum point U3. Further, an extension rate F is a difference L66 (not illustrated) between the distance L1 at the angle α and the distance L1 at the third maximum point P3 relative to an increase θ33 in the angle θ from the third maximum point P3 to the angle α. Further, the extension rate J is the distance L2 between the axis C1 of the rotational shaft X and the standard circumferential wall SW relative to an increase in the angle θ. In those cases, the curved circumferential wall 4c1 of the centrifugal blower 1 desirably has a relationship of extension rate J>extension rate D≥0, extension rate J>extension rate E≥0, and extension rate J>extension rate F≥0. Note that the curved circumferential wall 4c1 desirably has the shape defined by the extension rates illustrated in FIG. 13 but need not essentially have the shape defined by the extension rates illustrated in FIG. 13. Further, the curved circumferential wall 4c1 having the structure defined by the extension rates illustrated in FIG. 13 may be combined with the curved circumferential wall 4c1 having the structure defined by the extension rates illustrated in FIG. 7, the curved circumferential wall 4c1 having the structure defined by the extension rates illustrated in FIG. 10, or the curved circumferential wall 4c1 having the structure defined by the extension rates illustrated in FIG. 12.

Figure 14:
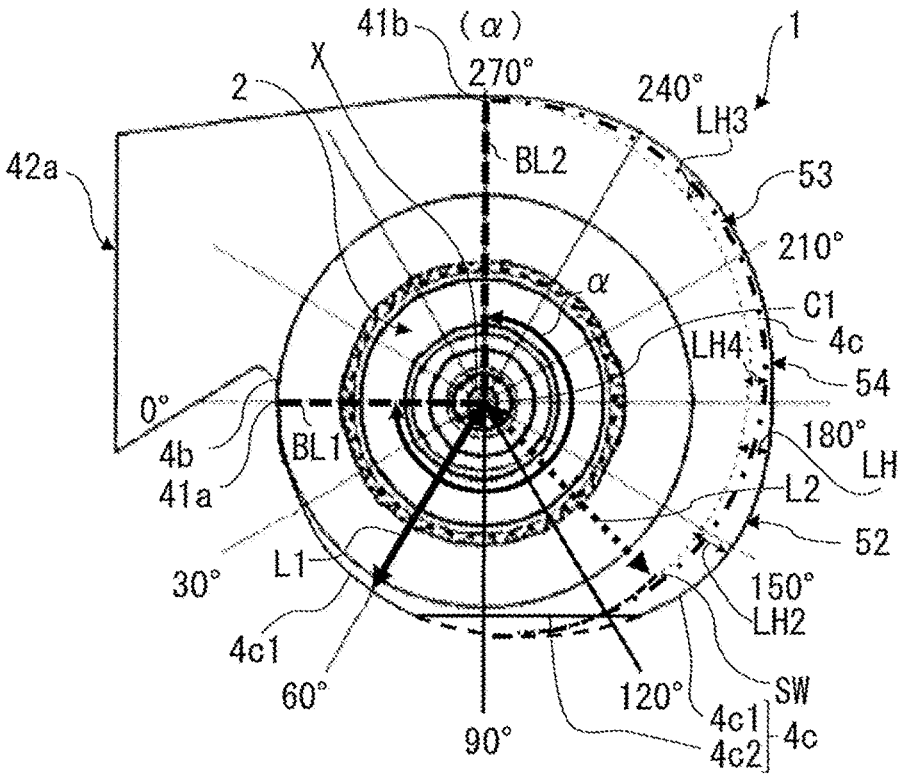
FIG. 14 is a top view illustrating comparison between a circumferential wall having other extension rates in the centrifugal blower according to Embodiment 1 of the present disclosure and the standard circumferential wall SW having the logarithmic spiral shape in the related-art centrifugal blower.
Figure 15:
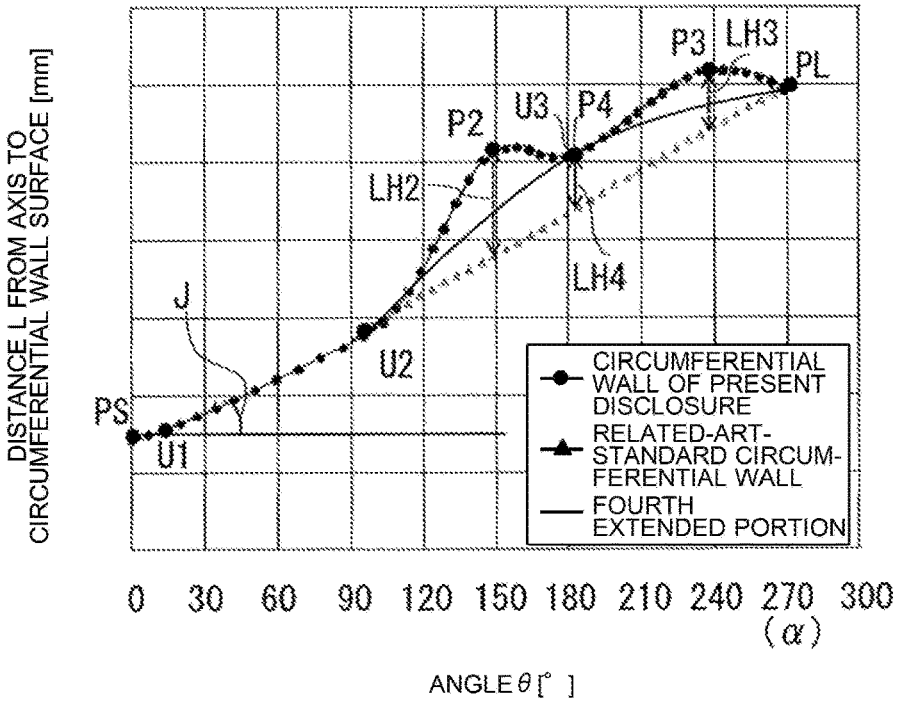
FIG. 15 is a diagram illustrating how the other extension rates of the extended portions are changed in the circumferential wall of the centrifugal blower of FIG. 14.

FIG. 14 is a top view illustrating comparison between a circumferential wall 4c having other extension rates in the centrifugal blower 1 according to Embodiment 1 of the present disclosure and the standard circumferential wall SW having the logarithmic spiral shape in the related-art centrifugal blower. FIG. 15 is a diagram illustrating how the other extension rates of the extended portions are changed in the circumferential wall 4c of the centrifugal blower 1 of FIG. 14. Note that the chain line illustrated in FIG. 14 shows a position of a fourth extended portion 54. In the centrifugal blower 1 according to Embodiment 1 in FIG. 14, the curved circumferential wall 4c1 includes the fourth extended portion 54 including a fourth maximum point P4 in the range of the angle θ from 90 degrees to 270 degrees (angle α) in the region opposite to the discharge port 72 of the scroll casing 4. In the centrifugal blower 1 according to Embodiment 1 in FIG. 14, the curved circumferential wall 4c1 further includes a second extended portion 52 including a second maximum point P2 and a third extended portion 53 including a third maximum point P3 on the fourth extended portion 54 including the fourth maximum point P4. As illustrated in FIG. 14, the curved circumferential wall 4c1 includes a circumferential wall conforming to the standard circumferential wall SW having the logarithmic spiral shape in the range of the angle θ greater than or equal to 0 degrees and smaller than 90 degrees. That is, in the curved circumferential wall 4c1, the distance L1 between the axis C1 of the rotational shaft X and the curved circumferential wall 4c1 is equal to the distance L2 between the axis C1 of the rotational shaft X and the standard circumferential wall SW in the range of the angle θ greater than or equal to 0 degrees and smaller than 90 degrees. As illustrated in FIG. 14, the curved circumferential wall 4c1 includes the second extended portion 52 bulging radially outward from the standard circumferential wall SW having the logarithmic spiral shape in the range of the angle θ greater than or equal to 90 degrees and smaller than 180 degrees. As illustrated in FIG. 15, the second extended portion 52 includes the second maximum point P2 in the range of the angle θ greater than or equal to 90 degrees and smaller than 180 degrees. The second maximum point P2 is a position on the curved circumferential wall 4*c*1 in the range of the angle θ greater than or equal to 90 degrees and smaller than 180 degrees, and has a maximum length being a difference LH2 between the distance L1 between the axis C1 of the rotational shaft X and the curved circumferential wall 4*c*1 and the distance L2 between the axis C1 of the rotational shaft X and the standard circumferential wall SW. As illustrated in FIG. 14, the curved circumferential wall 4*c*1 further includes the third extended portion 53 bulging radially outward from the standard circumferential wall SW having the logarithmic spiral shape in the range of the angle θ greater than or equal to 180 degrees and smaller than the angle α at the second reference line. As illustrated in FIG. 15, the third extended portion 53 includes the third maximum point P3 in the range of the angle θ greater than or equal to 180 degrees and smaller than the angle α at the second reference line. The third maximum point P3 is a position on the curved circumferential wall 4*c*1 in the range of the angle θ greater than or equal to 180 degrees and smaller than the angle α, and has a maximum length being a difference LH3 between the distance L1 between the axis C1 of the rotational shaft X and the curved circumferential wall 4*c*1 and the distance L2 between the axis C1 of the rotational shaft X and the standard circumferential wall SW. As illustrated in FIG. 14, the curved circumferential wall 4*c*1 includes the fourth extended portion 54 bulging radially outward from the standard circumferential wall SW having the logarithmic spiral shape in the range of the angle θ greater than or equal to 90 degrees and smaller than the angle α at the second reference line. As illustrated in FIG. 15, the fourth extended portion 54 includes the fourth maximum point P4 in the range of the angle θ greater than or equal to 90 degrees and smaller than the angle α at the second reference line. The fourth maximum point P4 is a position on the curved circumferential wall 4*c*1 in the range of the angle θ greater than or equal to 90 degrees and smaller than the angle α, and has a maximum length being a difference LH4 between the distance L1 between the axis C1 of the rotational shaft X and the curved circumferential wall 4*c*1 and the distance L2 between the axis C1 of the rotational shaft X and the standard circumferential wall SW. In the centrifugal blower 1, the curved circumferential wall 4*c*1 further includes the second extended portion 52 including the second maximum point P2 and the third extended portion 53 including the third maximum point P3 on the fourth extended portion 54 including the fourth maximum point P4. Therefore, in the curved circumferential wall 4*c*1 corresponding to the region from the second extended portion 52 to the third extended portion 53, the distance L1 between the axis C1 of the rotational shaft X and the curved circumferential wall 4*c*1 is greater than the distance L2 between the axis C1 of the rotational shaft X and the standard circumferential wall SW.

(Tongue Portion 4*b*)

The tongue portion 4*b* guides an air flow generated by the fan 2 to the discharge port 42*a* via the scroll portion 41. The tongue portion 4*b* is a projection provided at a boundary between the scroll portion 41 and the discharge portion 42. In the scroll casing 4, the tongue portion 4*b* runs in a direction parallel to the rotational shaft X.

[Operation of Centrifugal Blower 1]

When the fan 2 rotates, air outside the scroll casing 4 is suctioned into the scroll casing 4 through the suction port 5. The air suctioned into the scroll casing 4 is guided by the bellmouth 3 and suctioned into the fan 2. The air suctioned into the fan 2 is turned to be an air flow to which a dynamic pressure and a static pressure are added while the air passes through the plurality of blades 2*d*. The air flow is blown radially outward from the fan 2. While the air flow blown from the fan 2 is guided between the inner side of the circumferential wall 4*c* and the blades 2*d* in the scroll portion 41, the dynamic pressure is converted into a static pressure. After the air flow passes through the scroll portion 41, the air flow is blown out of the scroll casing 4 from the discharge port 42*a* of the discharge portion 42.

As described above, when the centrifugal blower 1 according to Embodiment 1 is compared with the centrifugal blower including the standard circumferential wall SW having the logarithmic spiral shape in the cross-section perpendicular to the rotational shaft X of the fan 2, the distance L1 is equal to the distance L2 at the first end 41*a* and the second end 41*b* of the circumferential wall 4*c*. Further, in the curved circumferential wall 4*c*1, the distance L1 is greater than or equal to the distance L2 between the first end 41*a* and the second end 41*b* of the circumferential wall 4*c*. Further, the curved circumferential wall 4*c*1 includes the plurality of extended portions between the first end 41*a* and the second end 41*b* of the circumferential wall 4*c*, and the extended portions include the maximum points each having the length being the difference LH between the distance L1 and the distance L2. In the centrifugal blower 1, the dynamic pressure is increased when the distance between the fan 2 and the wall surface of the circumferential wall 4*c* is minimum near the tongue portion 4*b*. Then, for pressure recovery from the dynamic pressure to the static pressure, the speed of the air flow is reduced by gradually increasing the distance between the fan 2 and the wall surface of the circumferential wall 4*c* in the air flow direction. Thus, the dynamic pressure is converted into the static pressure. At this time, ideally, the pressure recovery is promoted as the air flow moves along the circumferential wall 4*c* by a longer distance. Therefore, the air-sending efficiency can be increased. That is, the pressure recovery is most promoted in a structure in which the curved circumferential wall 4*c*1 has extension rates greater than or equal to those of a general logarithmic spiral shape (involute curve) and the extension rates are set so that the air flow is not separated along with, for example, abrupt extension of the circumferential wall 4*c* of the scroll portion 41 that may cause the air flow to turn substantially at a right angle. The centrifugal blower 1 according to Embodiment 1 includes the plurality of extended portions in addition to the general logarithmic spiral shape (involute curve). Thus, the air passage in the scroll portion 41 can be extended. As a result, the centrifugal blower 1 can prevent separation of the air flow and convert the dynamic pressure into the static pressure by reducing the speed of the air flow passing through the scroll casing 4. Accordingly, noise can be reduced and the air-sending efficiency can be improved. Further, even if the extension rate of the circumferential wall 4*c* of the scroll casing cannot sufficiently be secured in a specific direction because the outer diameter dimension is limited by an installation place, the centrifugal blower 1 has the structure described above in a direction in which the circumferential wall 4*c* can be extended, and therefore the air passage in which the distance between the axis C1 of the rotational shaft X and the circumferential wall 4*c* is increased can be extended. As a result, even if the extension rate of the circumferential wall 4*c* of the scroll casing cannot sufficiently be secured in a specific direction, the centrifugal blower 1 can prevent separation of the air flow and convert the dynamic pressure into the static pressure by reducing the speed of the air flow passing through the scroll casing 4. As a result, the centrifugal blower 1 can be downsized depending on the outer diameter dimension of the installation place, noise can be reduced, and the air-sending efficiency can be improved.

In recent years, an attempt has been made to allow devices accommodating the centrifugal blower (such as a ventilator and an indoor unit of an air-conditioning device) to be thinned so that the amount of projection from a wall or ceiling is reduced. If the entire scroll portion 41 is downsized to fit in the thinned device, the diameter of the fan 2 decreases. In the centrifugal blower 1, the circumferential wall 4*c* of the scroll portion 41 includes the curved circumferential wall 4*c*1 and the flat circumferential wall 4*c*2. Further, at least one straight portion is provided on the spiral contour of the circumferential wall 4*c* in top view. Therefore, there is no need to downsize the entire scroll portion 41. Thus, there is no need to reduce the fan diameter of the fan 2 accommodated in the scroll portion 41 and the centrifugal blower 1 can be downsized with the flat circumferential wall 4*c*2. Further, the air pressure can be maintained with the curved circumferential wall 4*c*1. As a result, the centrifugal blower 1 can be downsized depending on the outer diameter dimension of the installation place, noise can be reduced, and the air-sending efficiency can be improved. Further, the flat circumferential wall 4*c*2 of the circumferential wall 4*c* of the scroll portion 41 of the centrifugal blower 1 has at least one straight portion on the spiral contour of the circumferential wall 4*c* in top view. Therefore, the centrifugal blower 1 is stable when assembled and the workability of an engineer is improved during assembling. In particular, when the flat circumferential wall 4*c*2 is formed in a part where the angle θ is 90 degrees, the centrifugal blower 1 is more stable when assembled and the workability of the engineer is improved during assembling. Further, the vertical length of the scroll casing 4 can be reduced and the centrifugal blower 1 can be thinned. When the flat circumferential wall 4*c*2 is formed also in a part where the angle θ is 270 degrees, the vertical length of the scroll casing 4 can further be reduced and the centrifugal blower 1 can further be thinned. Further, when the flat circumferential wall 4*c*2 is formed on the discharge portion 42, the vertical length of the scroll casing 4 can further be reduced and the centrifugal blower 1 can further be thinned.

Further, the three extended portions of the centrifugal blower 1 include the first maximum point P1 in the range of the angle θ greater than or equal to 0 degrees and smaller than 90 degrees, the second maximum point P2 in the range of the angle θ greater than or equal to 90 degrees and smaller than 180 degrees, and the third maximum point P3 in the range of the angle θ greater than or equal to 180 degrees and smaller than the angle α at the second reference line. In the present disclosure, the extended portions including the three maximum points are provided in addition to the general logarithmic spiral shape (involute curve). Therefore, the air passage in the scroll portion 41 can be extended. In comparison with a structure with extended portions including two maximum points based on the extension rate of the related-art logarithmic spiral shape (involute curve), this structure is included in the structure with the extended portions including the three maximum points. Therefore, the structure with the extended portions including the three maximum points has the highest extension rate. Thus, in the centrifugal blower 1 having this relationship, the distance between the axis C1 of the rotational shaft X and the curved circumferential wall 4*c*1 can be increased compared with the distance in the related-art centrifugal blower including the standard circumferential wall SW having the logarithmic spiral shape. Accordingly, separation of the air flow can be prevented and the air passage can be extended. For example, if the contour dimension is limited because the device where the centrifugal blower 1 is installed (for example, an air-conditioning device) is thin, the distance between the axis C1 of the rotational shaft X and the curved circumferential wall 4*c*1 of the centrifugal blower 1 cannot be increased in a direction in which the angle θ is 270 degrees or 90 degrees. The centrifugal blower 1 has the three maximum points in the above ranges of the angle θ and therefore the air passage in which the distance between the axis C1 of the rotational shaft X and the curved circumferential wall 4*c*1 is increased can be extended even if the outer diameter dimension is limited because the device where the centrifugal blower 1 is installed is thin. As a result, the centrifugal blower 1 can prevent separation of the air flow and convert the dynamic pressure into the static pressure by reducing the speed of the air flow passing through the scroll casing 4. Thus, noise can be reduced and the air-sending efficiency can be improved.

Further, regarding the extension rates of the three extended portions of the curved circumferential wall 4*c*1, the centrifugal blower 1 has the relationship of extension rate B>extension rate C and extension rate B≥extension rate A>extension rate C or the relationship of extension rate B>extension rate C and extension rate B>extension rate C≥extension rate A. The scroll portion 41 has a function of increasing the dynamic pressure in the range of the angle θ from 0 degrees to 90 degrees. Therefore, conversion to the static pressure can be promoted when the extension rate in the range of the angle θ from 90 degrees to 180 degrees is increased rather than the extension rate in the range of the angle θ from 0 degrees to 90 degrees. Thus, in the centrifugal blower 1 having this relationship, the distance between the axis C1 of the rotational shaft X and the curved circumferential wall 4*c*1 can be increased compared with the distance in the related-art centrifugal blower including the standard circumferential wall SW having the logarithmic spiral shape. Accordingly, separation of the air flow can be prevented and the air passage can be extended in the range in which the conversion to the static pressure is efficient. As a result, the centrifugal blower 1 can prevent separation of the air flow and convert the dynamic pressure into the static pressure by reducing the speed of the air flow passing through the scroll casing 4. Thus, noise can be reduced and the air-sending efficiency can be improved. Further, if the contour dimension is limited because the device where the centrifugal blower 1 is installed (for example, an air-conditioning device) is thin, the distance between the axis C1 of the rotational shaft X and the curved circumferential wall 4*c*1 of the centrifugal blower 1 cannot be increased in the direction in which the angle θ is 270 degrees or 90 degrees. The centrifugal blower 1 has the extension rates described above and therefore the air passage in which the distance between the axis C1 of the rotational shaft X and the curved circumferential wall 4*c*1 is increased can be extended even if the outer diameter dimension is limited because the device where the centrifugal blower 1 is installed is thin. As a result, the centrifugal blower 1 can prevent separation of the air flow and convert the dynamic pressure into the static pressure by reducing the speed of the air flow passing through the scroll casing 4. Thus, noise can be reduced and the air-sending efficiency can be improved.

Further, regarding the extension rates of the three extended portions of the curved circumferential wall 4*c*1, the centrifugal blower 1 has the relationship of extension rate C>extension rate B≥extension rate A. The scroll portion 41 has the function of increasing the dynamic pressure in the range of the angle θ from 0 degrees to 90 degrees. Therefore, the conversion to the static pressure can be promoted when the extension rate in the range of the angle θ from 90 degrees to 180 degrees is increased rather than the extension rate in the range of the angle θ from 0 degrees to 90 degrees. However, the scroll portion 41 partially has the function of increasing the dynamic pressure also in the range of the angle θ from 90 degrees to 180 degrees. Therefore, the air-sending efficiency is further increased when the extension rate in the range of the angle θ from 180 degrees to 270 degrees is increased rather than the extension rate in the range of the angle θ from 90 degrees to 180 degrees. The scroll portion 41 substantially loses the function of increasing the dynamic pressure in a range in which the distance between the fan 2 and the curved circumferential wall 4*c*1 is maximum (angle θ from 180 degrees to 270 degrees). By maximizing the extension rate of the scroll portion 41 in this range, the air-sending efficiency can be maximized. As a result, in the centrifugal blower 1, noise can be reduced and the air-sending efficiency can be improved.

Further, the plurality of extended portions of the centrifugal blower 1 include the first extended portion 51 including the first maximum point P1 in the range of the angle θ greater than or equal to 0 degrees and smaller than 90 degrees, the second extended portion 52 including the second maximum point P2 in the range of the angle θ greater than or equal to 90 degrees and smaller than 180 degrees, and the third extended portion 53 including the third maximum point P3 in the range of the angle θ greater than or equal to 180 degrees and smaller than the angle α at the second reference line. Further, in the curved circumferential wall 4*c*1 corresponding to the region from the second extended portion 52 to the third extended portion 53, the distance L1 between the axis C1 of the rotational shaft X and the curved circumferential wall 4*c*1 is greater than the distance L2 between the axis C1 of the rotational shaft X and the standard circumferential wall SW. The centrifugal blower 1 has a structure in which the scroll bulges in a direction opposite to the direction to the discharge port 72. With the effects of the three extended portions and the bulging scroll, the scroll wall surface along which the air flow passes can be extended. As a result, the centrifugal blower 1 can prevent separation of the air flow and convert the dynamic pressure into the static pressure by reducing the speed of the air flow passing through the scroll casing 4. Thus, noise can be reduced and the air-sending efficiency can be improved.

Further, the plurality of extended portions of the centrifugal blower 1 include the second extended portion 52 including the second maximum point P2 in the range of the angle θ greater than or equal to 90 degrees and smaller than 180 degrees, and the third extended portion 53 including the third maximum point P3 in the range of the angle θ greater than or equal to 180 degrees and smaller than the angle α at the second reference line. Further, in the curved circumferential wall 4*c*1 corresponding to the region from the second extended portion 52 to the third extended portion 53, the distance L1 between the axis C1 of the rotational shaft X and the curved circumferential wall 4*c*1 is greater than the distance L2 between the axis C1 of the rotational shaft X and the standard circumferential wall SW. The centrifugal blower 1 has the structure in which the scroll bulges in the direction opposite to the direction to the discharge port 72. With the effects of the two extended portions and the bulging scroll, the scroll wall surface along which the air flow passes can be extended. As a result, the centrifugal blower 1 can prevent separation of the air flow and convert the dynamic pressure into the static pressure by reducing the speed of the air flow passing through the scroll casing 4. Thus, noise can be reduced and the air-sending efficiency can be improved.

Further, the curved circumferential wall 4*c*1 of the centrifugal blower 1 desirably has the relationship of extension rate J>extension rate D≥0, extension rate J>extension rate E≥0, and extension rate J>extension rate F≥0. With the extension rates of the curved circumferential wall 4*c*1 of the centrifugal blower 1, the air passage between the rotational shaft X and the curved circumferential wall 4*c*1 is not narrowed and the air flow generated by the fan 2 does not have any pressure loss. As a result, the centrifugal blower 1 can convert the dynamic pressure into the static pressure by reducing the speed of the air flow, noise can be reduced, and the air-sending efficiency can be improved.

Embodiment 2

Figure 16:
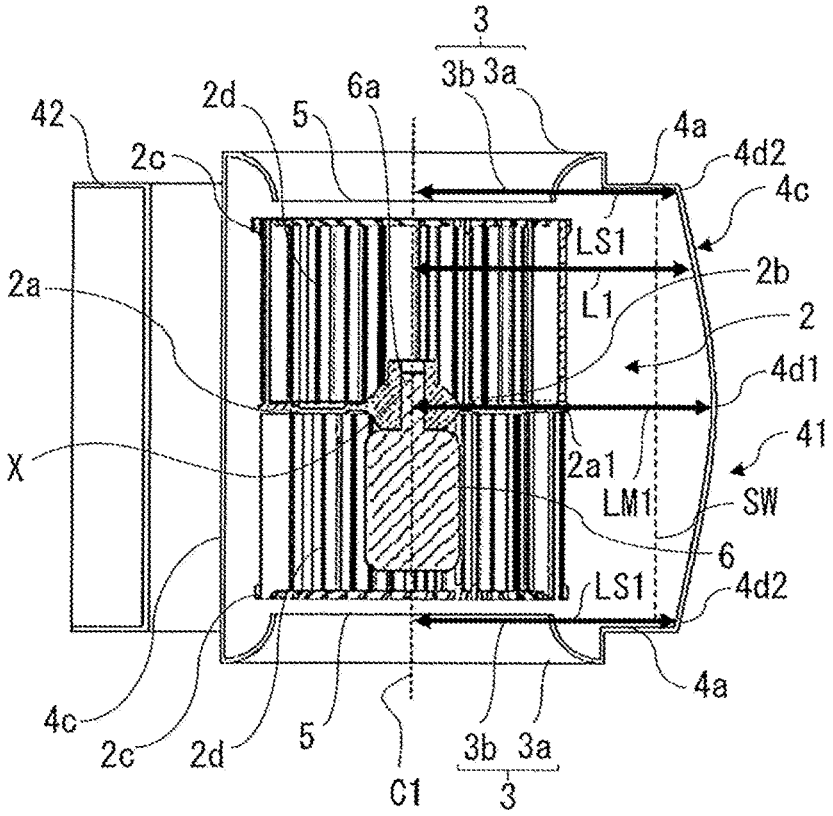
FIG. 16 is a sectional view cut along an axis direction, illustrating a centrifugal blower according to Embodiment 2 of the present disclosure.

FIG. 16 is a sectional view cut along an axis direction, illustrating a centrifugal blower 1 according to Embodiment 2 of the present disclosure. The dotted line in FIG. 16 shows the position of the standard circumferential wall SW having the logarithmic spiral shape in the related-art centrifugal blower. Note that portions having the same structures as those of the centrifugal blower 1 of FIG. 1 to FIG. 15 are represented by the same reference signs and description thereof is omitted. The centrifugal blower 1 of Embodiment 2 includes the double-suction scroll casing 4 including the side walls 4*a* having the suction ports 5 on both sides of the main plate 2*a* in the axis direction of the rotational shaft X. As illustrated in FIG. 16, in the centrifugal blower 1 of Embodiment 2, the circumferential wall 4*c* is extended in the radial direction of the rotational shaft X as a point on the circumferential wall 4*c* increases its distance from the suction port 5 in the axis direction of the rotational shaft X. That is, in the centrifugal blower 1 of Embodiment 2, the distance between the axis C1 of the rotational shaft X and the inner wall surface of the circumferential wall 4*c* increases as a point on the circumferential wall 4*c* increases its distance from the suction port 5 in the axis direction of the rotational shaft X. In the circumferential wall 4*c* of the centrifugal blower 1, the distance L1 between the axis C1 of the rotational shaft X and the inner wall surface of the circumferential wall 4*c* is maximum in a direction parallel to the axis direction of the rotational shaft X at a part 4*d*1 facing the circumferential portion 2*a*1 of the main plate 2*a*. A distance LM1 illustrated in FIG. 16 is the maximum distance L1 between the axis C1 of the rotational shaft X and the inner wall surface of the circumferential wall 4*c* in the direction parallel to the axis direction of the rotational shaft X at the part 4*d*1 where the circumferential wall 4*c* faces the circumferential portion 2*a*1 of the main plate 2*a*. In the circumferential wall 4*c* of the centrifugal blower 1, the distance L1 between the axis C1 of the rotational shaft X and the inner wall surface of the circumferential wall 4*c* is minimum in the direction parallel to the axis direction of the rotational shaft X at a part 4*d*2 being a boundary between the circumferential wall 4*c* and the side wall 4*a*. A distance LS1 illustrated in FIG. 16 is the minimum distance L1 between the axis C1 of the rotational shaft X and the inner wall surface of the circumferential wall 4*c* in the direction parallel to the axis direction of the rotational shaft X at the part 4*d*2 being the boundary between the circumferential wall 4*c* and the side wall 4*a*. In the direction parallel to the rotational shaft X, the circumferential wall 4*c* bulges at the part 4*d*1 facing the circumferential portion 2*a*1 of the main plate 2*a* and the distance L1 is maximum in the direction parallel to the rotational shaft X at the part 4*d*1 facing the circumferential portion 2*a*1 of the main plate 2*a*. In other words, in the centrifugal blower 1 of Embodiment 2, in sectional view parallel to the rotational shaft X, the circumferential wall 4*c* is formed into an arc shape so that the distance L1 between the axis C1 of the rotational shaft X and the inner wall surface of the circumferential wall 4*c* is maximum at the part facing the circumferential portion 2*a*1 of the main plate 2*a*. Note that it is appropriate that the cross-section of the circumferential wall 4*c* project so that the distance L1 between the axis C1 of the rotational shaft X and the inner wall surface of the circumferential wall 4*c* is maximum at the part 4*d*1 where the circumferential wall 4*c* faces the circumferential portion 2*a*1 of the main plate 2*a*. The cross-section may partially or entirely have a straight portion.

Figure 17:
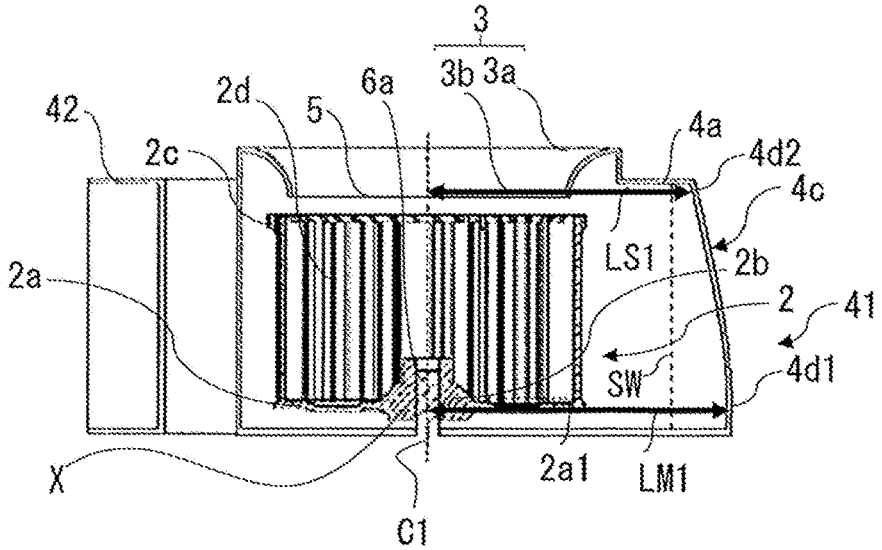
FIG. 17 is a sectional view cut along the axis direction, illustrating a modified example of the centrifugal blower according to Embodiment 2 of the present disclosure.

FIG. 17 is a sectional view cut along the axis direction, illustrating a modified example of the centrifugal blower 1 according to Embodiment 2 of the present disclosure. The dotted line in FIG. 17 shows the position of the standard circumferential wall SW having the logarithmic spiral shape in the related-art centrifugal blower. Note that portions having the same structures as those of the centrifugal blower 1 of FIG. 1 to FIG. 15 are represented by the same reference signs and description thereof is omitted. The centrifugal blower 1 in the modified example of Embodiment 2 includes the single-suction scroll casing 4 including the side wall 4*a* having the suction port 5 on one side of the main plate 2*a* in the axis direction of the rotational shaft X. As illustrated in FIG. 17, in the modified example of the centrifugal blower 1 of Embodiment 2, the circumferential wall 4*c* is extended in the radial direction of the rotational shaft X as a point on the circumferential wall 4*c* increases its distance from the suction port 5 in the axis direction of the rotational shaft X. That is, in the centrifugal blower 1 of Embodiment 2, the distance between the axis C1 of the rotational shaft X and the inner wall surface of the circumferential wall 4*c* increases as a point on the circumferential wall 4*c* increases its distance from the suction port 5 in the axis direction of the rotational shaft X. In the circumferential wall 4*c* of the centrifugal blower 1, the distance L1 between the axis C1 of the rotational shaft X and the inner wall surface of the circumferential wall 4*c* is maximum in the direction parallel to the axis direction of the rotational shaft X at a part 4*d*1 facing the circumferential portion 2*a*1 of the main plate 2*a*. A distance LM1 illustrated in FIG. 17 is the maximum distance L1 between the axis C1 of the rotational shaft X and the inner wall surface of the circumferential wall 4*c* in the direction parallel to the axis direction of the rotational shaft X at the part 4*d*1 where the circumferential wall 4*c* faces the circumferential portion 2*a*1 of the main plate 2*a*. In the circumferential wall 4*c* of the centrifugal blower 1, the distance L1 between the axis C1 of the rotational shaft X and the inner wall surface of the circumferential wall 4*c* is minimum in the direction parallel to the axis direction of the rotational shaft X at a part 4*d*2 being a boundary between the circumferential wall 4*c* and the side wall 4*a*. A distance LS1 illustrated in FIG. 17 is the minimum distance L1 between the axis C1 of the rotational shaft X and the inner wall surface of the circumferential wall 4*c* in the direction parallel to the axis direction of the rotational shaft X at the part 4*d*2 being the boundary between the circumferential wall 4*c* and the side wall 4*a*. In the direction parallel to the rotational shaft X, the circumferential wall 4*c* bulges at the part 4*d*1 facing the circumferential portion 2*a*1 of the main plate 2*a* and the distance L1 is maximum in the direction parallel to the rotational shaft X at the part 4*d*1 facing the circumferential portion 2*a*1 of the main plate 2*a*. In other words, in the centrifugal blower 1 of Embodiment 2, in sectional view parallel to the rotational shaft X, the circumferential wall 4*c* is formed into a curved shape so that the distance L1 between the axis C1 of the rotational shaft X and the inner wall surface of the circumferential wall 4*c* is maximum at the part facing the circumferential portion 2*a*1 of the main plate 2*a*. Note that it is appropriate that the cross-section of the circumferential wall 4*c* project so that the distance L1 between the axis C1 of the rotational shaft X and the inner wall surface of the circumferential wall 4*c* is maximum at the part 4*d*1 where the circumferential wall 4*c* faces the circumferential portion 2*a*1 of the main plate 2*a*. The cross-section may partially or entirely have a straight portion.

Figure 18:
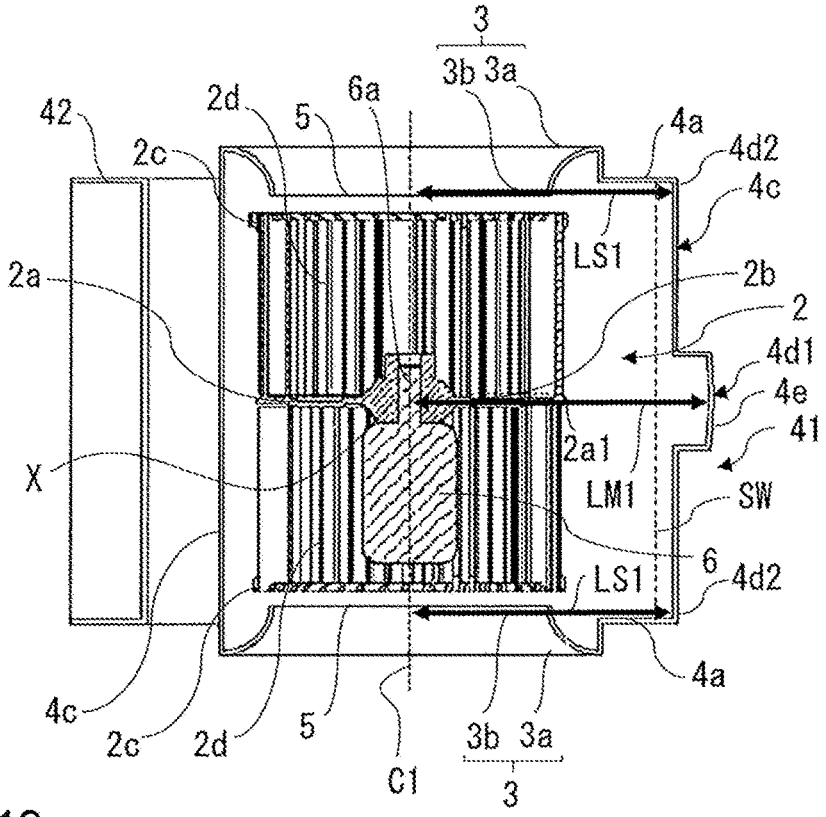
FIG. 18 is a sectional view cut along the axis direction, illustrating another modified example of the centrifugal blower according to Embodiment 2 of the present disclosure.

FIG. 18 is a sectional view cut along the axis direction, illustrating another modified example of the centrifugal blower 1 according to Embodiment 2 of the present disclosure. The dotted line in FIG. 18 shows the position of the standard circumferential wall SW having the logarithmic spiral shape in the related-art centrifugal blower. Note that portions having the same structures as those of the centrifugal blower 1 of FIG. 1 to FIG. 15 are represented by the same reference signs and description thereof is omitted. The centrifugal blower 1 in the other modified example of Embodiment 2 includes the double-suction scroll casing 4 including the side walls 4*a* having the suction ports 5 on both sides of the main plate 2*a* in the axis direction of the rotational shaft X. As illustrated in FIG. 18, in the centrifugal blower 1 of Embodiment 2, one part on the circumferential wall 4*c* in the axis direction of the rotational shaft X is a protrusion 4*e* that protrudes in the radial direction of the rotational shaft X at a part 4*d*1 facing the circumferential portion 2*a*1 of the main plate 2*a*. At the protrusion 4*e* that is one part on the circumferential wall 4*c* in the axis direction of the rotational shaft X, the distance between the axis C1 of the rotational shaft X and the inner wall surface of the circumferential wall 4*c* increases. Further, the protrusion 4*e* runs in a longitudinal direction of the circumferential wall 4*c* between the first end 41*a* and the second end 41*b*. Note that the protrusion 4*e* may be formed over the entire range of the circumferential wall 4*c* between the first end 41*a* and the second end 41*b* or may be formed at a part of the circumferential wall 4*c* between the first end 41*a* and the second end 41*b*. In a circumferential direction of the rotational shaft X, the circumferential wall 4*c* has a protrusion 4*e* that protrudes in the radial direction of the rotational shaft X. In the circumferential wall 4*c* of the centrifugal blower 1, the distance L1 between the axis C1 of the rotational shaft X and the inner wall surface of the circumferential wall 4*c* is maximum in the direction parallel to the axis direction of the rotational shaft X at the part 4*d*1 facing the circumferential portion 2*a*1 of the main plate 2*a*. That is, in the circumferential wall 4*c* of the centrifugal blower 1, the distance L1 between the axis C1 of the rotational shaft X and the inner wall surface of the circumferential wall 4*c* is maximum in the direction parallel to the axis direction of the rotational shaft X at the protrusion 4*e*. A distance LM1 illustrated in FIG. 18 is the maximum distance L1 between the axis C1 of the rotational shaft X and the inner wall surface of the circumferential wall 4*c* in the direction parallel to the axis direction of the rotational shaft X at the part 4*d*1 where the circumferential wall 4*c* faces the circumferential portion 2*a*1 of the main plate 2*a*. In the circumferential wall 4*c* of the centrifugal blower 1, the distance L1 between the axis C1 of the rotational shaft X and the inner wall surface of the circumferential wall 4*c* is minimum in the direction parallel to the axis direction of the rotational shaft X at a part 4*d*2 being a boundary between the circumferential wall 4*c* and the side wall 4*a*. A distance LS1 illustrated in FIG. 18 is the minimum distance L1 between the axis C1 of the rotational shaft X and the inner wall surface of the circumferential wall 4*c* in the direction parallel to the axis direction of the rotational shaft X at the part 4*d*2 being the boundary between the circumferential wall 4*c* and the side wall 4*a*. As illustrated in FIG. 18, in the circumferential wall 4*c*, the distance LS1 between the axis C1 of the rotational shaft X and the inner wall surface of the circumferential wall 4*c* is constant in the axis direction of the rotational shaft X. Note that the protrusion 4*e* is formed into a rectangular sectional shape including straight portions but may be formed into, for example, an arc shape including a curved portion or other shapes including a straight portion and a curved portion. Further, the circumferential wall 4*c* is not limited to the circumferential wall in which the distance LS1 between the axis C1 of the rotational shaft X and the inner wall surface of the circumferential wall 4*c* is constant in the axis direction of the rotational shaft X. For example, in the circumferential wall 4*c*, the distance L1 between the axis C1 of the rotational shaft X and the inner wall surface of the circumferential wall 4*c* may increase in a range from the side wall 4*a* to the protrusion 4*e*.

The related-art centrifugal blower including the standard circumferential wall SW having the logarithmic spiral shape has the following characteristics in air flows passing through air passages at the part 4*d*1 and the part 4*d*2 of the circumferential wall 4*c* in the direction parallel to the axis direction of the rotational shaft X. In the related-art centrifugal blower, the speed of the air flow increases and the dynamic pressure increases in the air passage between the rotational shaft X and the part 4*d*1 of the circumferential wall 4*c*. Further, in the related-art centrifugal blower, the speed of the air flow decreases and the dynamic pressure decreases in the air passage between the rotational shaft X and the part 4*d*2 of the circumferential wall 4*c*. Therefore, in the related-art centrifugal blower, the air flow may fail to move along the inner circumferential surface of the circumferential wall 4*c* at the end of the suction side rather than the center of the circumferential wall 4*c* in the direction parallel to the axis direction of the rotational shaft X. In contrast, in the centrifugal blower 1 of Embodiment 2 and the centrifugal blower 1 of each modified example, when viewed in the direction parallel to the rotational shaft X, the distance L1 between the axis C1 of the rotational shaft X and the inner wall surface of the circumferential wall 4*c* is maximum at the part 4*d*1 where the circumferential wall 4*c* faces the circumferential portion 2*a*1 of the main plate 2*a*. Therefore, the air flow is likely to concentrate on the air passage at the part 4*d*1 of the circumferential wall 4*c* where the speed of the air flow increases and the dynamic pressure increases along the cross-section of the circumferential wall 4*c*. Thus, the air passage where the speed of the air flow decreases and the dynamic pressure decreases can be reduced in size. As a result, in the centrifugal blowers 1 of Embodiment 2 and each modified example, the air flow can efficiently move along the inner circumferential surface of the circumferential wall 4*c*.

As described above, in the centrifugal blowers 1 according to Embodiment 2 and each modified example, when viewed in the direction parallel to the rotational shaft X, the distance L1 between the axis C1 of the rotational shaft X and the inner wall surface of the circumferential wall 4*c* is maximum at the part 4*d*1 where the circumferential wall 4*c* faces the circumferential portion 2*a*1 of the main plate 2*a*. Therefore, in the cross-section of the circumferential wall 4*c* parallel to the rotational shaft X, the air flow is likely to concentrate on the air passage at the part 4*d*1 of the circumferential wall 4*c* where the speed of the air flow increases and the dynamic pressure increases. In contrast, in the cross-section of the circumferential wall 4*c* parallel to the rotational shaft X, the amount of the air flow is reduced in the air passage at the part 4*d*2 of the circumferential wall 4*c* where the speed of the air flow decreases and the dynamic pressure decreases. As a result, in the centrifugal blowers 1 of Embodiment 2 and each modified example, the air flow can efficiently move along the inner circumferential surface of the circumferential wall 4*c*. Further, in the centrifugal blower 1, the distance between the axis C1 of the rotational shaft X and the circumferential wall 4*c* can be increased compared with the distance in the related-art centrifugal blower including the standard circumferential wall SW having the logarithmic spiral shape. Accordingly, separation of the air flow can be prevented and the air passage can be extended. As a result, the centrifugal blower 1 can convert the dynamic pressure into the static pressure by reducing the speed of the air flow, noise can be reduced, and the air-sending efficiency can be improved.

Embodiment 3

[Air-Sending Device 30]

Figure 19:
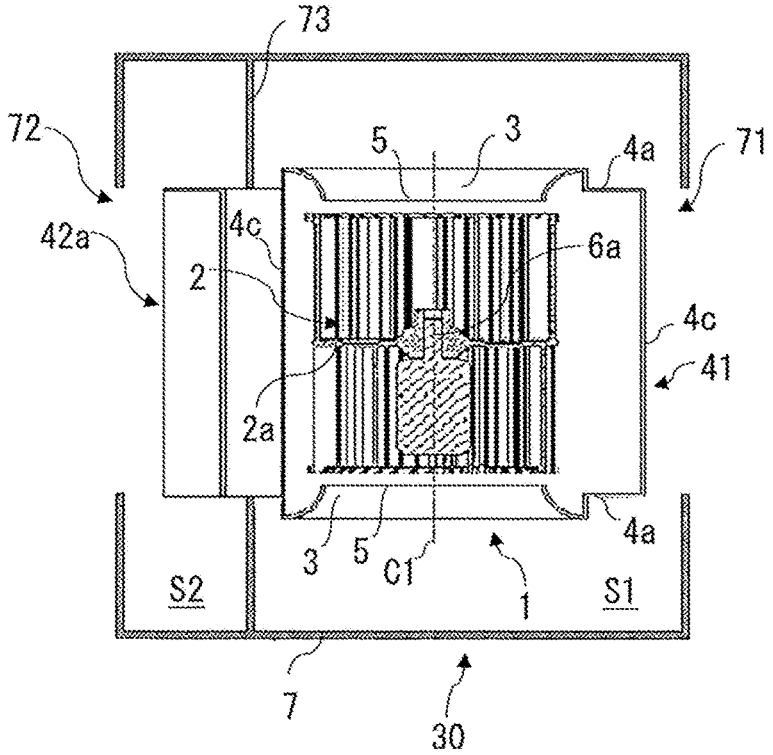
FIG. 19 is a diagram illustrating the structure of an air-sending device according to Embodiment 3 of the present disclosure.

FIG. 19 is a diagram illustrating the structure of an air-sending device 30 according to Embodiment 3 of the present disclosure. Portions having the same structures as those of the centrifugal blower 1 of FIG. 1 to FIG. 15 are represented by the same reference signs and description thereof is omitted. Examples of the air-sending device 30 according to Embodiment 3 include a ventilator and a desk fan. The air-sending device 30 includes the centrifugal blower 1 according to Embodiment 1 or 2, and a case 7 configured to accommodate the centrifugal blower 1. The case 7 has two openings, which are a suction port 71 and a discharge port 72. As illustrated in FIG. 19, the suction port 71 and the discharge port 72 of the air-sending device 30 face each other. Note that the suction port 71 and the discharge port 72 of the air-sending device 30 need not essentially face each other. For example, the suction port 71 or the discharge port 72 may be formed above or below the centrifugal blower 1. In the case 7, a space 51 including the suction port 71 and a space S2 including the discharge port 72 are separated from each other by a partition plate 73. The centrifugal blower 1 is installed with the suction port 5 located in the space 51 including the suction port 71 and the discharge port 42*a* located in the space S2 including the discharge port 72.

When the fan 2 rotates, air is suctioned into the case 7 through the suction port 71. The air suctioned into the case 7 is guided by the bellmouth 3 and suctioned into the fan 2. The air suctioned into the fan 2 is blown radially outward from the fan 2. After the air blown from the fan 2 passes through the scroll casing 4, the air is blown from the discharge port 42*a* of the scroll casing 4 and then from the discharge port 72.

Since the air-sending device 30 according to Embodiment 3 includes the centrifugal blower 1 according to Embodiment 1 or 2, pressure recovery can be performed efficiently. Thus, the air-sending efficiency can be improved and noise can be reduced.

Embodiment 4

[Air-Conditioning Device 40]

Figure 20:
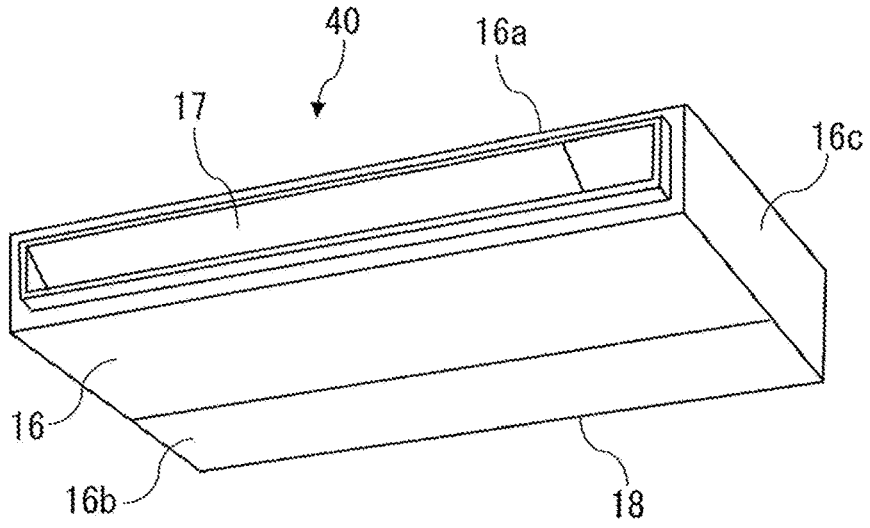
FIG. 20 is a perspective view of an air-conditioning device according to Embodiment 4 of the present disclosure.
Figure 21:
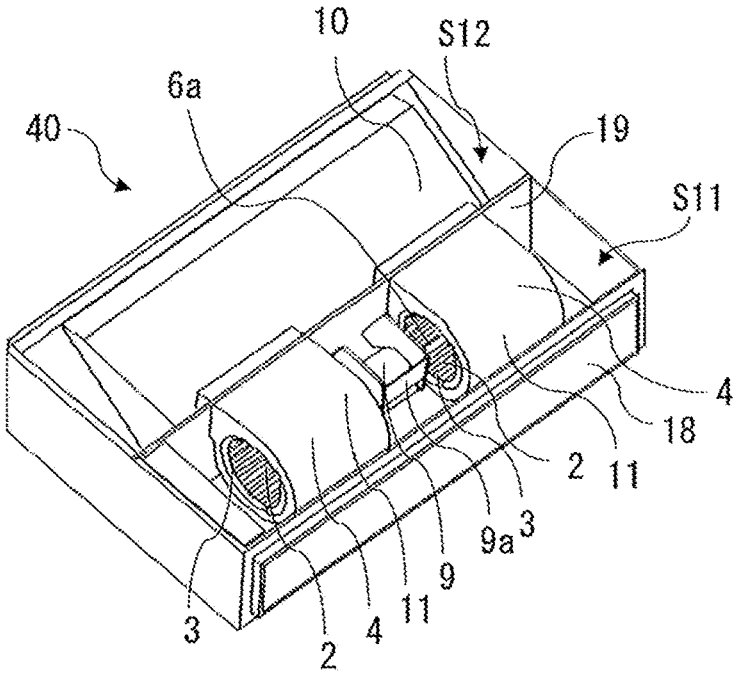
FIG. 21 is a diagram illustrating the internal structure of the air-conditioning device according to Embodiment 4 of the present disclosure.
Figure 22:
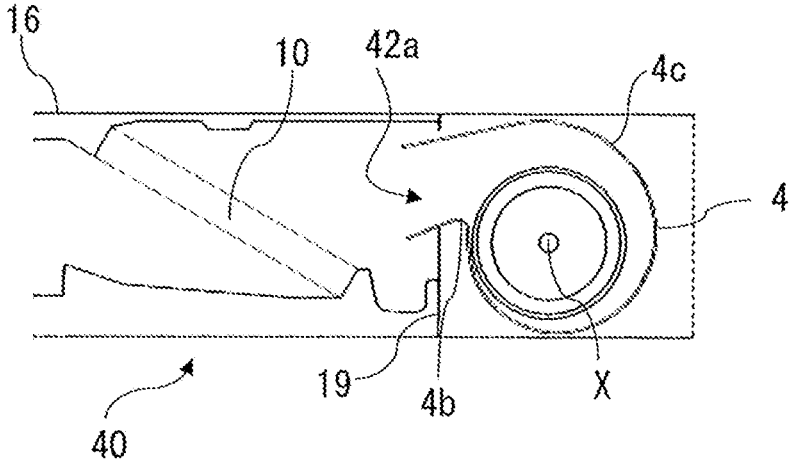
FIG. 22 is a sectional view of the air-conditioning device according to Embodiment 4 of the present disclosure.

FIG. 20 is a perspective view of an air-conditioning device 40 according to Embodiment 4 of the present disclosure. FIG. 21 is a diagram illustrating the internal structure of the air-conditioning device 40 according to Embodiment 4 of the present disclosure. FIG. 22 is a sectional view of the air-conditioning device 40 according to Embodiment 4 of the present disclosure. Note that, in each centrifugal blower 11 used in the air-conditioning device 40 according to Embodiment 4, portions having the same structures as those of the centrifugal blower 1 of FIG. 1 to FIG. 15 are represented by the same reference signs and description thereof is omitted. Further, a top portion 16*a* is omitted from FIG. 21 for illustration of the internal structure of the air-conditioning device 40. The air-conditioning device 40 according to Embodiment 4 includes the centrifugal blower 1 described in Embodiment 1 or 2, and a heat exchanger 10 facing the discharge port 42*a* of the centrifugal blower 1. The air-conditioning device 40 according to Embodiment 4 further includes a case 16 installed above a ceiling of an air-conditioned room. As illustrated in FIG. 20, the case 16 is formed into a cubic shape including the top portion 16*a*, a bottom portion 16*b*, and side portions 16*c*. Note that the shape of the case 16 is not limited to the cubic shape and may be, for example, a columnar shape, a prism shape, a conical shape, a shape including a plurality of corners, a shape including a plurality of curved portions, or other shapes.

(Case 16)

The case 16 includes a side portion 16*c* having a case discharge port 17 as one of the side portions 16*c*. As illustrated in FIG. 20, the shape of the case discharge port 17 is a rectangular shape. Note that the shape of the case discharge port 17 is not limited to the rectangular shape and may be, for example, a circular shape, an oval shape, or other shapes. The case 16 includes, as one of the side portions 16*c*, a side portion 16*c* having a case suction port 18 on a rear side opposite to the side where the case discharge port 17 is formed. As illustrated in FIG. 21, the shape of the case suction port 18 is a rectangular shape. Note that the shape of the case suction port 18 is not limited to the rectangular shape and may be, for example, a circular shape, an oval shape, or other shapes. A filter may be disposed in the case suction port 18 to remove dust in air.

The case 16 accommodates two centrifugal blowers 11, a fan motor 9, and the heat exchanger 10. Each centrifugal blower 11 includes a fan 2 and a scroll casing 4 having a bellmouth 3. The shape of the bellmouth 3 of the centrifugal blower 11 is similar to the shape of the bellmouth 3 of the centrifugal blower 1 of Embodiment 1. The centrifugal blower 11 includes the fan 2 and the scroll casing 4 similar to those of the centrifugal blower 1 according to Embodiment 1 but differs from the centrifugal blower 1 in that the fan motor 6 is not disposed in the scroll casing 4. The fan motor 9 is supported by a motor support 9*a* fixed to the top portion 16*a* of the case 16. The fan motor 9 includes an output shaft 6*a*. The output shaft 6*a* runs in parallel to the side portion 16*c* having the case suction port 18 and the side portion 16*c* having the case discharge port 17. As illustrated in FIG. 21, two fans 2 are attached to the output shaft 6*a* in the air-conditioning device 40. The fan 2 forms a flow of air to be suctioned into the case 16 from the case suction port 18 and blown to an air-conditioned space from the case discharge port 17. Note that the number of the fans 2 to be disposed in the case 16 is not limited to two but may be one, three, or more.

As illustrated in FIG. 21, each centrifugal blower 11 is attached to a partition plate 19. The internal space of the case 16 is partitioned by the partition plate 19 into a space S11 on a suction side of the scroll casing 4 and a space S12 on a discharge side of the scroll casing 4.

As illustrated in FIG. 22, the heat exchanger 10 faces a discharge port 42*a* of each centrifugal blower 11. In the case 16, the heat exchanger 10 is disposed on an air passage of air to be discharged by the centrifugal blower 11. The heat exchanger 10 adjusts the temperature of air to be suctioned into the case 16 from the case suction port 18 and blown to the air-conditioned space from the case discharge port 17. Note that the heat exchanger 10 may have a structure known in the art.

When the fan 2 rotates, air in the air-conditioned space is suctioned into the case 16 through the case suction port 18. The air suctioned into the case 16 is guided by the bellmouth 3 and suctioned into the fan 2. The air suctioned into the fan 2 is blown radially outward from the fan 2. After the air blown from the fan 2 passes through the scroll casing 4, the air is blown from the discharge port 42*a* of the scroll casing 4 and then supplied to the heat exchanger 10. The air supplied to the heat exchanger 10 exchanges heat and the humidity is adjusted while the air passes through the heat exchanger 10. The air passing through the heat exchanger 10 is blown to the air-conditioned space from the case discharge port 17.

Since the air-conditioning device 40 according to Embodiment 4 includes the centrifugal blower 1 according to Embodiment 1 or 2, pressure recovery can be performed efficiently. Thus, the air-sending efficiency can be improved and noise can be reduced.

Embodiment 5

[Refrigeration Cycle Device 50]

Figure 23:
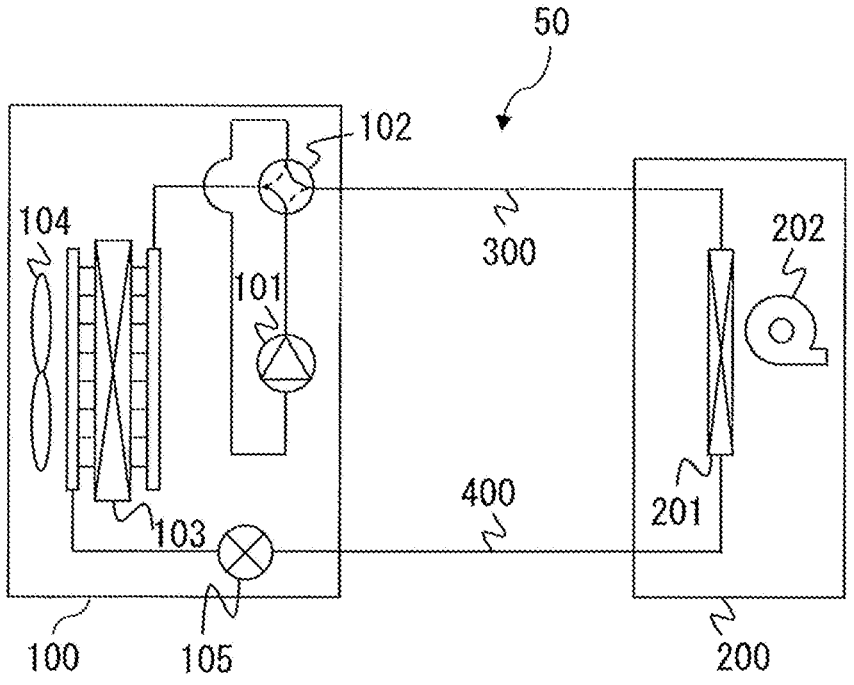
FIG. 23 is a diagram illustrating the structure of a refrigeration cycle device according to Embodiment 5 of the present disclosure.

FIG. 23 is a diagram illustrating the structure of a refrigeration cycle device 50 according to Embodiment 5 of the present disclosure. Note that, in a centrifugal blower 1 used in the refrigeration cycle device 50 according to Embodiment 5, portions having the same structures as those of the centrifugal blower 1 of FIG. 1 to FIG. 15 or the centrifugal blower 11 are represented by the same reference signs and description thereof is omitted. The refrigeration cycle device 50 according to Embodiment 5 transfers heat between outdoor air and indoor air via refrigerant to heat or cool a room, thereby performing air conditioning. The refrigeration cycle device 50 according to Embodiment 5 includes an outdoor unit 100 and an indoor unit 200. In the refrigeration cycle device 50, a refrigerant circuit through which the refrigerant circulates is formed by connecting the outdoor unit 100 and the indoor unit 200 by a refrigerant pipe 300 and a refrigerant pipe 400. The refrigerant pipe 300 is a gas pipe through which refrigerant in a gas phase flows. The refrigerant pipe 400 is a liquid pipe through which refrigerant in a liquid phase flows. Note that two-phase gas-liquid refrigerant may flow through the refrigerant pipe 400. Further, in the refrigerant circuit of the refrigeration cycle device 50, a compressor 101, a flow switching device 102, an outdoor heat exchanger 103, an expansion valve 105, and an indoor heat exchanger 201 are sequentially connected via refrigerant pipes.

(Outdoor Unit 100)

The outdoor unit 100 includes the compressor 101, the flow switching device 102, the outdoor heat exchanger 103, and the expansion valve 105. The compressor 101 compresses suctioned refrigerant and discharges the compressed refrigerant. Here, the compressor 101 may include an inverter that changes an operation frequency to change the capacity of the compressor 101. Note that the capacity of the compressor 101 is an amount of refrigerant sent out per unit time. Examples of the flow switching device 22 include a four-way valve. The flow switching device 22 changes the direction of a refrigerant passage. The refrigeration cycle device 50 can achieve a heating operation or a cooling operation by changing a flow of refrigerant with the flow switching device 102 based on an instruction from a controller (not illustrated).

The outdoor heat exchanger 103 causes heat exchange to be performed between refrigerant and outdoor air. During the heating operation, the outdoor heat exchanger 103 functions as an evaporator and exchanges heat between outdoor air and low-pressure refrigerant flowing into the outdoor heat exchanger 103 from the refrigerant pipe 400 to evaporate and gasify the refrigerant. During the cooling operation, the outdoor heat exchanger 103 functions as a condenser and exchanges heat between outdoor air and refrigerant compressed by the compressor 101 and flowing into the outdoor heat exchanger 103 from the flow switching device 102 to condense and liquefy the refrigerant. The outdoor heat exchanger 103 is provided with an outdoor blower 104 to increase the efficiency of the heat exchange between the refrigerant and the outdoor air. The outdoor blower 104 may be provided with an inverter that changes an operation frequency of a fan motor to change the rotation speed of a fan. The expansion valve 105 is an expansion device (flow rate control device). The flow rate control device functions as the expansion valve by controlling the flow rate of refrigerant flowing through the expansion valve 105. The expansion valve 105 regulates the pressure of refrigerant by changing its opening degree. For example, if the expansion valve 105 is an electronic expansion valve, the opening degree is adjusted based on an instruction from the controller (not illustrated) or other devices.

(Indoor Unit 200)

The indoor unit 200 includes the indoor heat exchanger 201 configured to exchange heat between refrigerant and indoor air, and an indoor blower 202 configured to regulate a flow of air to be subjected to the heat exchange by the indoor heat exchanger 201. During the heating operation, the indoor heat exchanger 201 functions as a condenser and exchanges heat between indoor air and refrigerant flowing into the indoor heat exchanger 201 from the refrigerant pipe 300 to condense and liquefy the refrigerant. Then, the refrigerant flows out of the indoor heat exchanger 201 toward the refrigerant pipe 400. During the cooling operation, the indoor heat exchanger 201 functions as an evaporator and causes heat exchange to be performed between indoor air and refrigerant having a low pressure through the expansion valve 105 so that the refrigerant removes heat from the air. Thus, the refrigerant is evaporated and gasified and then flows out of the indoor heat exchanger 201 toward the refrigerant pipe 300. The indoor blower 202 faces the indoor heat exchanger 201. The centrifugal blower 1 according to Embodiment 1 or 2 or the centrifugal blower 11 according to Embodiment 5 is applied to the indoor blower 202. The operation speed of the indoor blower 202 is determined by user settings. The indoor blower 202 may be provided with an inverter that changes an operation frequency of the fan motor 6 to change the rotation speed of the fan 2.

[Examples of Operation of Refrigeration Cycle Device 50]

Next, the cooling operation is described as an example of the operation of the refrigeration cycle device 50. High-temperature and high-pressure gas refrigerant compressed and discharged by the compressor 101 flows into the outdoor heat exchanger 103 via the flow switching device 102. The gas refrigerant flowing into the outdoor heat exchanger 103 is condensed into low-temperature refrigerant by exchanging heat with outdoor air sent by the outdoor blower 104. The low-temperature refrigerant flows out of the outdoor heat exchanger 103. The refrigerant flowing out of the outdoor heat exchanger 103 is expanded by the expansion valve 105 and the pressure is reduced to turn into low-temperature and low-pressure two-phase gas-liquid refrigerant. The two-phase gas-liquid refrigerant flows into the indoor heat exchanger 201 of the indoor unit 200 and is evaporated into low-temperature and low-pressure gas refrigerant by exchanging heat with indoor air sent by the indoor blower 202. The low-temperature and low-pressure gas refrigerant flows out of the indoor heat exchanger 201. At this time, the indoor air cooled by the refrigerant that removes heat from the indoor air becomes conditioned air (blown air) and is blown to a room (air-conditioned space) from an air outlet of the indoor unit 200. The gas refrigerant flowing out of the indoor heat exchanger 201 is suctioned into the compressor 101 via the flow switching device 102 and is compressed again. The operation described above is repeated.

Next, the heating operation is described as an example of the operation of the refrigeration cycle device 50. High-temperature and high-pressure gas refrigerant compressed and discharged by the compressor 101 flows into the indoor heat exchanger 201 of the indoor unit 200 via the flow switching device 102. The gas refrigerant flowing into the indoor heat exchanger 201 is condensed into low-temperature refrigerant by exchanging heat with indoor air sent by the indoor blower 202. The low-temperature refrigerant flows out of the indoor heat exchanger 201. At this time, the indoor air heated by receiving heat from the gas refrigerant becomes conditioned air (blown air) and is blown to the room (air-conditioned space) from the air outlet of the indoor unit 200. The refrigerant flowing out of the indoor heat exchanger 201 is expanded by the expansion valve 105 and the pressure thereof is reduced to turn into low-temperature and low-pressure two-phase gas-liquid refrigerant. The two-phase gas-liquid refrigerant flows into the outdoor heat exchanger 103 of the outdoor unit 100 and is evaporated into low-temperature and low-pressure gas refrigerant by exchanging heat with outdoor air sent by the outdoor blower 104. The low-temperature and low-pressure gas refrigerant flows out of the outdoor heat exchanger 103. The gas refrigerant flowing out of the outdoor heat exchanger 103 is suctioned into the compressor 101 via the flow switching device 102 and is compressed again. The operation described above is repeated.

Since the refrigeration cycle device 50 according to Embodiment 5 includes the centrifugal blower 1 according to Embodiment 1 or 2, pressure recovery can be performed efficiently. Thus, the air-sending efficiency can be improved and noise can be reduced.

The structures described in Embodiments 1 to 5 are illustrative of examples of the present disclosure and may be combined with other publicly-known technologies or partially omitted or modified without departing from the spirit of the present disclosure.

REFERENCE SIGNS LIST

1 centrifugal blower 2 fan 2*a* main plate 2*a*1 circumferential portion 2*b* boss 2*c* side plate 2*d* blade 2*e* suction port 3 bellmouth 3*a* upstream end 3*b* downstream end 4 scroll casing 4*a* side wall 4*b* tongue portion 4*c* circumferential wall 4*c*1 curved circumferential wall 4*c*2 flat circumferential wall 4*e* protrusion 5 suction port 6 fan motor 6*a* output shaft 7 case 9 fan motor 9*a* motor support 10 heat exchanger 11 centrifugal blower 16 case 16*a* top portion 16*b* bottom portion 16*c* side portion 17 case discharge port 18 case suction port 19 partition plate 22 flow switching device 30 air-sending device 40 air-conditioning device 41 scroll portion 41*a* first end 41*b* second end 42 discharge portion 42*a* discharge port 50 refrigeration cycle device 51 first extended portion 52 second extended portion 53 third extended portion 54 fourth extended portion 71 suction port 72 discharge port 73 partition plate 100 outdoor unit 101 compressor 102 flow switching device 103 outdoor heat exchanger 104 outdoor blower 105 expansion valve 200 indoor unit 201 indoor heat exchanger 202 indoor blower 300 refrigerant pipe 400 refrigerant pipe

The invention claimed is:

1. A centrifugal blower comprising:

a fan including a main plate having a disk-shape, and a plurality of blades installed on a circumferential portion of the main plate; and a scroll casing configured to accommodate the fan, the scroll casing including a discharge portion forming a discharge port from which an air flow generated by the fan is discharged, and a scroll portion including a side wall covering the fan in an axis direction of a rotational shaft of the fan, and formed with a suction port configured to suction air, a circumferential wall encircling the fan in a radial direction of the rotational shaft, and a tongue portion provided between the discharge portion and the circumferential wall, and configured to guide the air flow generated by the fan to the discharge port, the circumferential wall including a curved circumferential wall formed into a curved shape, and a flat circumferential wall formed into a flat shape, in comparison with a centrifugal blower including a standard circumferential wall having a spiral shape defined by a predetermined extension rate in cross-section perpendicular to the rotational shaft of the fan, in the curved circumferential wall, at a first end being a boundary between the circumferential wall and the tongue portion and at a second end being a boundary between the circumferential wall and the discharge portion, a distance L1 between an axis of the rotational shaft and the circumferential wall being equal to a distance L2 between the axis of the rotational shaft and the standard circumferential wall, the distance L1 being greater than or equal to the distance L2 between the first end and the second end of the circumferential wall, the circumferential wall including a plurality of extended portions between the first end and the second end of the circumferential wall, the plurality of extended portions comprising maximum points each having a length being a difference LH between the distance L1 and the distance L2, when an angle θ is defined along a rotational direction of the fan from a first reference line connecting the axis of the rotational shaft and the first end toward a second reference line connecting the axis of the rotational shaft and the second end in the cross-section perpendicular to the rotational shaft of the fan, the plurality of extended portions have two extended portions in a range of the angle θ greater than or equal to 90 degrees and smaller than the angle α at the second reference line, the distance L1 is greater than the distance L2 in the circumferential wall corresponding to a region between the two extended portions; and the flat circumferential wall being formed in at least one part on the curved circumferential wall.

2. The centrifugal blower of claim 1, wherein the flat circumferential wall is formed in a part where the angle θ is 90 degrees.

3. The centrifugal blower of claim 2, wherein the flat circumferential wall is further formed in a part where the angle θ is 270 degrees.

4. The centrifugal blower of claim 1, wherein the flat circumferential wall is formed on the discharge portion.

5. The centrifugal blower of claim 1, wherein the two extended portions include:

a maximum point in a range of the angle θ greater than or equal to 90 degrees and smaller than 180 degrees; and another maximum point in a range of the angle θ greater than or equal to 180 degrees and smaller than an angle a at the second reference line.

6. The centrifugal blower of claim 1, wherein the plurality of extended portions include the two extended portions and another extended portion, a first extended portion comprising the first maximum point P1 in the range of the angle θ greater than or equal to 0 degrees and smaller than 90 degrees;

a second extended portion comprising the second maximum point P2 in the range of the angle θ greater than or equal to 90 degrees and smaller than 180 degrees; and a third extended portion comprising the third maximum point P3 in the range of the angle θ greater than or equal to 180 degrees and smaller than the angle α at the second reference line, wherein, when a first minimum point U1 is given as a point where the difference LH is minimum in a range of the angle θ greater than or equal to 0 degrees and smaller than an angle at the first maximum point P1, when a second minimum point U2 is given as a point where the difference LH is minimum in a range of the angle θ greater than or equal to 90 degrees and smaller than an angle at the second maximum point P2, when a third minimum point U3 is given as a point where the difference LH is minimum in a range of the angle θ greater than or equal to 180 degrees and smaller than an angle at the third maximum point P3, when an extension rate A is a difference L11 between the distance L1 at the first maximum point P1 and the distance L1 at the first minimum point U1 relative to an increase θ1 in the angle θ from the first minimum point U1 to the first maximum point P1, when an extension rate B is a difference L22 between the distance L1 at the second maximum point P2 and the distance L1 at the second minimum point U2 relative to an increase θ2 in the angle θ from the second minimum point U2 to the second maximum point P2, and when an extension rate C is a difference L33 between the distance L1 at the third maximum point P3 and the distance L1 at the third minimum point U3 relative to an increase θ3 in the angle θ from the third minimum point U3 to the third maximum point P3, the centrifugal blower has a relationship of:

extension rate B>extension rate C and extension rate B≥extension rate A>extension rate C; or extension rate B>extension rate C and extension rate B>extension rate C≥extension rate A.

7. The centrifugal blower of claim 6, wherein when an extension rate D is a difference L44 between the distance L1 at the second minimum point U2 and the distance L1 at the first maximum point P1 relative to an increase θ11 in the angle θ from the first maximum point P1 to the second minimum point U2, when an extension rate E is a difference L55 between the distance L1 at the third minimum point U3 and the distance L1 at the second maximum point P2 relative to an increase θ22 in the angle θ from the second maximum point P2 to the third minimum point U3, when an extension rate F is a difference L66 between the distance L1 at the angle α and the distance L1 at the third maximum point P3 relative to an increase θ33 in the angle θ from the third maximum point P3 to the angle α, and when an extension rate J is the distance L2 between the axis of the rotational shaft and the standard circumferential wall relative to an increase in the angle θ, the centrifugal blower has a relationship of:

extension rate J>extension rate D≥0;

extension rate J>extension rate E≥0; and extension rate J>extension rate F≥0.

8. The centrifugal blower of claim 1, wherein the plurality of extended portions include the two extended portions and another extended portion, a first extended portion comprising the first maximum point P1 in the range of the angle θ greater than or equal to 0 degrees and smaller than 90 degrees;

a second extended portion comprising the second maximum point P2 in the range of the angle θ greater than or equal to 90 degrees and smaller than 180 degrees; and a third extended portion comprising the third maximum point P3 in the range of the angle θ greater than or equal to 180 degrees and smaller than the angle α at the second reference line, wherein, when a first minimum point U1 is given as a point where the difference LH is minimum in a range of the angle θ greater than or equal to 0 degrees and smaller than an angle at the first maximum point P1, when a second minimum point U2 is given as a point where the difference LH is minimum in a range of the angle θ greater than or equal to 90 degrees and smaller than an angle at the second maximum point P2, when a third minimum point U3 is given as a point where the difference LH is minimum in a range of the angle θ greater than or equal to 180 degrees and smaller than an angle at the third maximum point P3, when an extension rate A is a difference L11 between the distance L1 at the first maximum point P1 and the distance L1 at the first minimum point U1 relative to an increase θ1 in the angle θ from the first minimum point U1 to the first maximum point P1, when an extension rate B is a difference L22 between the distance L1 at the second maximum point P2 and the distance L1 at the second minimum point U2 relative to an increase θ2 in the angle θ from the second minimum point U2 to the second maximum point P2, and when an extension rate C is a difference L33 between the distance L1 at the third maximum point P3 and the distance L1 at the third minimum point U3 relative to an increase θ3 in the angle θ from the third minimum point U3 to the third maximum point P3, the centrifugal blower has a relationship of extension rate C>extension rate B≥extension rate A.

9. The centrifugal blower of claim 1, wherein the plurality of extended portions include:

the two extended portions and another extended portion, a first extended portion comprising a first maximum point P1 in the range of the angle θ greater than or equal to 0 degrees and smaller than 90 degrees;

a second extended portion comprising a second maximum point P2 in the range of the angle θ greater than or equal to 90 degrees and smaller than 180 degrees; and a third extended portion comprising a third maximum point P3 in the range of the angle θ greater than or equal to 180 degrees and smaller than the angle α at the second reference line, and the distance L1 is greater than the distance L2 in the curved circumferential wall corresponding to a region from the second extended portion to the third extended portion.

10. The centrifugal blower of claim 1, wherein in a direction parallel to the rotational shaft, the circumferential wall bulges at a part facing the circumferential portion of the main plate, and the distance L1 is maximum in the direction parallel to the rotational shaft at the part facing the circumferential portion of the main plate.

11. The centrifugal blower of claim 1, wherein, in a circumferential direction of the rotational shaft, the circumferential wall comprises a protrusion that protrudes in the radial direction of the rotational shaft.

12. An air-sending device comprising:

the centrifugal blower of claim 1; and a case configured to accommodate the centrifugal blower.

13. An air-conditioning device comprising:

the centrifugal blower of claim 1; and a heat exchanger facing the discharge port of the centrifugal blower.

14. A refrigeration cycle device comprising the centrifugal blower of claim 1.

* * * * *